US009042754B2

(12) United States Patent
Ohkubo et al.

(10) Patent No.: US 9,042,754 B2
(45) Date of Patent: May 26, 2015

(54) IMAGE FORMING APPARATUS HAVING LATENT IMAGE TIMING

(71) Applicant: CANON KABUSHIKI KAISHA, Tokyo (JP)

(72) Inventors: Takateru Ohkubo, Susono (JP); Satoshi Nakashima, Mishima (JP); Kenji Watanabe, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/632,455

(22) Filed: Oct. 1, 2012

(65) Prior Publication Data

US 2013/0089345 A1 Apr. 11, 2013

(30) Foreign Application Priority Data

Oct. 5, 2011 (JP) ..... 2011-220915

(51) Int. Cl.
*G03G 15/043* (2006.01)
*G03G 15/00* (2006.01)

(52) U.S. Cl.
CPC ..... *G03G 15/043* (2013.01); *G03G 15/5033* (2013.01)

(58) Field of Classification Search
CPC ..... G03G 15/5033; G03G 15/043
USPC ..... 399/49, 51, 167, 48, 301
See application file for complete search history.

(56) References Cited

U.S. PATENT DOCUMENTS 5,278,586 A * 1/1994 Yoneda et al. ..... 347/116
5,950,048 A * 9/1999 Okumura et al. ..... 399/113
6,408,157 B1 * 6/2002 Tanaka et al. ..... 399/301
7,382,387 B2 * 6/2008 Ichikawa et al. ..... 347/131

(Continued)

FOREIGN PATENT DOCUMENTS

CN 101609284 A 12/2009
JP 63-55708 A 3/1988
JP 6-274077 A 9/1994
JP H06-274077 A 9/1994

(Continued)

OTHER PUBLICATIONS

Chinese Office Action dated Nov. 3, 2014, in related Chinese Patent Application No. 201210371196.6 (with English translation).

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

An image forming apparatus includes a photosensitive member, a rotation member that rotates to rotate the photosensitive member, a light emitter that emits light to the photosensitive member and forms a latent image, a detector that detects the latent image on the photosensitive member positioned at a detecting position, a measuring device that measures time, and a correcting device that performs a correction according to a variation of a light emission position of the light emitter from a reference light emission position. The measuring device measures a time interval from a time when the latent image is formed on the photosensitive member by the light emitter to a time when the latent image reaches the detecting position and is detected by the detector, and the correcting device performs the correction based on the time interval measured by the measuring device.

40 Claims, 31 Drawing Sheets

(56) References Cited

U.S. PATENT DOCUMENTS

| | | | | |
|---|---|---|---|---|
| 7,598,746 | B2 * | 10/2009 | Kono et al. | 324/458 |
| 8,396,395 | B2 * | 3/2013 | Aoyagi | 399/167 |
| 2004/0033090 | A1 * | 2/2004 | Yamanaka et al. | 399/301 |
| 2006/0177246 | A1 * | 8/2006 | Kawada et al. | 399/301 |
| 2010/0215382 | A1 * | 8/2010 | Yoshida et al. | 399/12 |
| 2012/0003016 | A1 * | 1/2012 | Uchiyama et al. | 399/301 |

FOREIGN PATENT DOCUMENTS

| | | | |
|---|---|---|---|
| JP | 10-39571 | A | 2/1998 |
| JP | S63-055708 | A | 3/1998 |
| JP | 10-123791 | A | 5/1998 |
| JP | 3333360 | B2 | 10/2002 |
| JP | 2005-292735 | A | 10/2005 |
| JP | 2005-292736 | A | 10/2005 |
| JP | 2011-186260 | A | 9/2011 |

* cited by examiner

FIG. 29

| GEAR | THE NUMBER OF GEAR TEETH | NUMBER OF ROTATIONS | ROTATION NUMBER CORRESPONDING TO DISTANCE BETWEEN E AND D |
|---|---|---|---|
| MOTOR GEAR (721) | 15 | 38.1 | 36.00 |
| IDLER GEAR (722) | 135 | 4.2 | 4.00 |
| IDLER STAGE GEAR (723) — LARGE DIAMETER GEAR (723a) | 135 | 4.2 | 4.00 |
| IDLER STAGE GEAR (723) — SMALL DIAMETER GEAR (723b) | 26 | 4.2 | 4.00 |
| PHOTOSENSITIVE MEMBER GEAR (724) | 110 | 1.0 | 0.95 |

IMAGE FORMING APPARATUS HAVING LATENT IMAGE TIMING

BACKGROUND OF THE INVENTION

1. Field of the Invention

The present invention relates to an image forming apparatus using an electrophotographic system.

2. Description of the Related Art

In an image forming apparatus of an electrophotographic system, a laser beam is emitted on a rotating photosensitive drum to expose the surface of the photosensitive drum to form an electrostatic latent image. It is known that a position deviation occurs between scans when a toner is developed for high-speed printing, due to an exposing position variation of a scan interval relative to the rotation direction or due to a rotation variation of the photosensitive drum.

The position deviation degrades the image quality or reduces the lifetime due to nonconformity of charge bias timing provided to an image processing member in image formation or due to nonconformity of rotation start timing.

In Japanese Patent Publication No. S63-055708, an electrostatic latent image depicted on a photosensitive drum and a surface potential of the photosensitive drum changed by the electrostatic latent image are detected, and the strength of the laser beam is controlled based on the detected potential signal. This can prevent the degradation in the image quality caused by the relative position deviation in the vertical scanning direction periodically generated between the laser beam and the photosensitive drum.

In Japanese Patent Application Laid-Open No. H06-274077, a gear that rotates a photosensitive drum rotates an integer number of times while the photosensitive drum rotates from an exposing position to a transfer position to prevent expansion and contraction of a toner image in the rotation direction due to rotation unevenness of the photosensitive drum. Equalization of the rotation unevenness of the photosensitive drum between the exposing position and the transfer position is proposed.

SUMMARY OF THE INVENTION

However, a relative position deviation between the exposing position and the processing means occurs in Japanese Patent Publication No. S63-055708 due to, for example, a temperature increase in the main body of the apparatus. In that case, it is difficult to detect the relative position deviation from the exposing position to processing means (development roller, transfer roller and charge roller) that can detect electrostatic latent image potential, before and after the increase in the temperature.

Furthermore, rotation variations of a drive source, such as a motor, an idler gear and a photosensitive member gear are combined in the rotation and drive of the photosensitive drum. As a result, the rotation velocities of the photosensitive drum upon the formation of the electrostatic latent image and upon the arrival at the processing means do not match, and the rotation unevenness is reflected on the detection time. There is a problem that the detection time of the detection by the detector is deviated, and the detection accuracy is reduced.

In Japanese Patent Application Laid-Open No. H06-274077, the rotation unevenness of the photosensitive drum between the exposing position and the transfer position can be equalized to prevent the expansion and contraction of the toner image in the rotation direction caused by the rotation unevenness of the photosensitive drum. However, the detection accuracy of the detection of the rotation velocity of the photosensitive drum is not improved.

An object of the present invention is to provide an image forming apparatus comprising: a photosensitive member; a rotation member that rotates to drive the photosensitive member; a light emitter for emitting light to the photosensitive member to form a latent image; a detector for detecting arrival of the latent image formed on the photosensitive member at a detecting position; a measuring device that measures time; and a correcting device for performing correction according to a variation of a light emission position of the light emitter from a reference light emission position, wherein the measuring device measures a time interval between the formation of the latent image on the photosensitive member by the light emitter and the detection of the arrival at the detecting position by the detector, wherein the correcting device performs the correction based on the time interval measured by the measuring device, and wherein the latent image formed, by the light emitter, on the photosensitive member at the reference light emission position reaches the detecting position when the rotation member rotates an integer number of times.

Further features of the present invention will become apparent from the following description of exemplary embodiments with reference to the attached drawings.

BRIEF DESCRIPTION OF THE DRAWINGS

FIG. 5A is a diagram including a chain line illustrating the velocity variations when the points on the surface of the photosensitive drum pass through the exposing position, an alternate long and short dash line illustrating the velocity variations when the points on the surface of the photosensitive drum pass through the detecting position, and a solid line illustrating a difference between the velocity variations at the exposing position and the velocity variations at the detecting position.

FIG. 22B is a diagram including a chain line illustrating the velocity variations when the points on the surface of the photosensitive drum pass through the exposing position, an alternate long and short dash line illustrating the velocity variations when the points on the surface of the photosensitive drum pass through the detecting position, and a solid line illustrating a difference between the velocity variations at the exposing position and the velocity variations at the detecting position.

FIG. 29 is a diagram illustrating a specific example of the numbers of gear teeth and the numbers of rotations of the motor gear, the idler gear and the idler stage gear as well as the numbers of rotation between the exposing positions E and D of the second embodiment illustrated in FIG. 20B.

DESCRIPTION OF THE EMBODIMENTS

Preferred embodiments of the present invention will now be described in detail in accordance with the accompanying drawings.

Exemplary embodiments of an image forming apparatus according to the present invention will now be described in detail with reference to the drawings. However, constituent elements described in the following embodiments are illustrative only and are not intended to limit the scope of the present invention.

First Embodiment

A configuration of a first embodiment of the image forming apparatus according to the present invention will be described with reference to FIGS. 1 to 18.

<Overall Configuration of Image Forming Apparatus>

Figure 1:
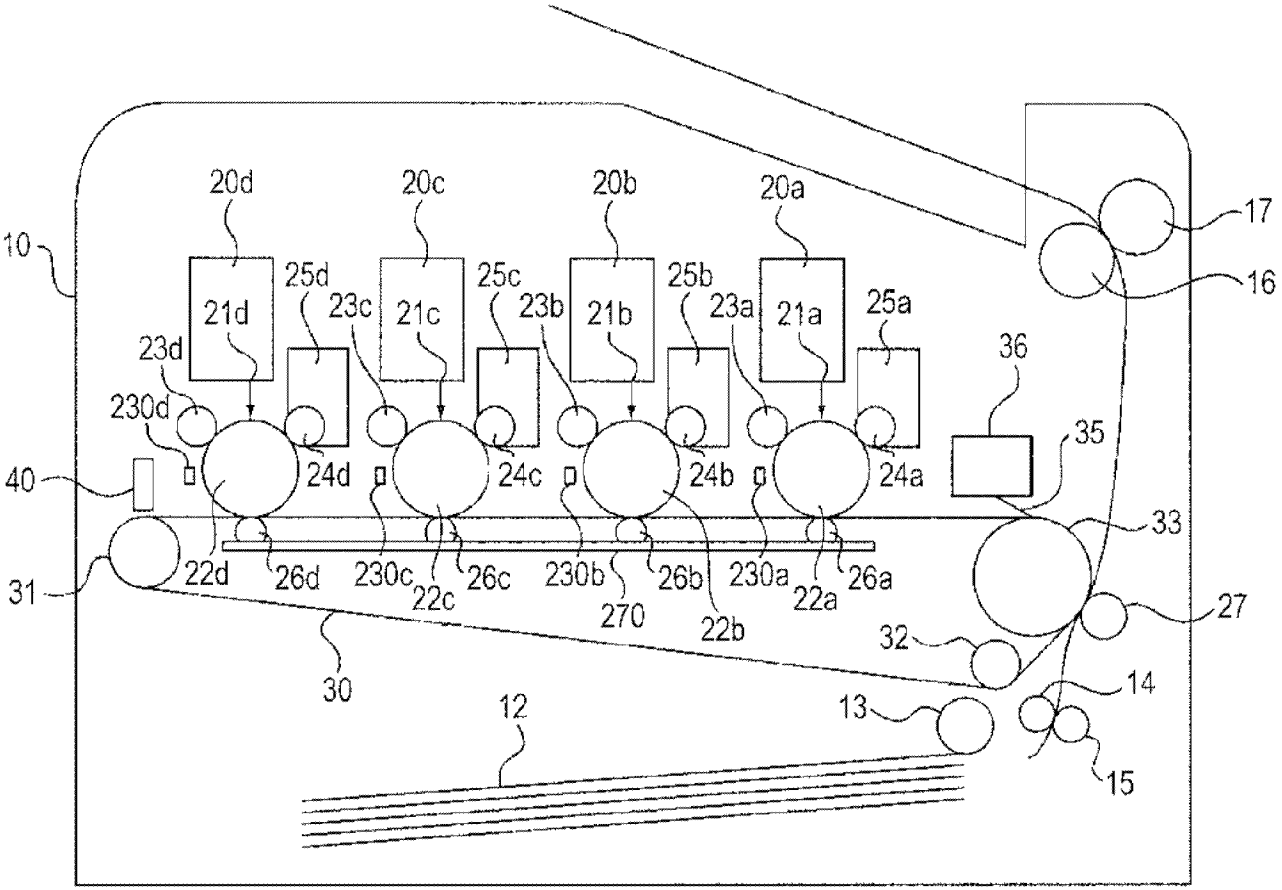
FIG. 1 is a cross-sectional explanatory diagram illustrating a configuration of a first embodiment of an image forming apparatus according to the present invention.

FIG. 1 is a configuration diagram of an image forming apparatus 10 according to a first embodiment. In FIG. 1, charge rollers 23*a*, 23*b*, 23*c* and 23*d* as charge means of the image forming apparatus 10 uniformly charge surfaces of photosensitive drums 22*a*, 22*b*, 22*c* and 22*d* as a plurality of image carriers that are rotated and driven. Laser scanner units 20*a*, 20*b*, 20*c* and 20*d* as exposure means expose the surfaces of the photosensitive drums 22*a*, 22*b*, 22*c* and 22*d* uniformly charged by the charge rollers 23*a*, 23*b*, 23*c* and 23*d* to form electrostatic latent images at predetermined latent image forming positions. Development apparatuses 25*a*, 25*b*, 25*c* and 25*d* as a developing device develop and visualize the latent images by toners to form an image.

To prevent complication of the description, a photosensitive drum 22 represents the four photosensitive drums 22*a*, 22*b*, 22*c* and 22*d* of yellow Y, magenta M, cyan C and black Bk in the description. The same applies to related image formation process means.

The laser scanner units 20*a* to 20*d* sequentially emit laser beams 21*a* to 21*d* to the surfaces of the rotated and driven photosensitive drums 22*a* to 22*d*. In this case, pre-exposure devices 230*a* to 230*d* expose the photosensitive drums 22*a* to 22*d* to level the surface potentials, and then the charge rollers 23*a* to 23*d* charge the photosensitive drums 22*a* to 22*d* in advance. Therefore, electrostatic latent images are formed by the emission of the laser beams 21*a* to 21*d*.

Development apparatuses 25*a* to 25*d* and developing sleeves 24*a* to 24*d* put toners over the electrostatic latent images formed on the surfaces of the photosensitive drums 22*a* to 22*d* to form toner images. Primary transfer rollers 26*a* to 26*d* transfer the toner images of the photosensitive drums 22*a* to 22*d* to an intermediate transfer belt 30. A member group that includes the photosensitive drum 22 and that is directly related to the formation of the toner image by the charge roller 23, the development apparatus 25 and the primary transfer roller 26 will be called an image forming unit. The member group may also include the laser scanner unit 20 to be called an image forming unit.

The members (the pre-exposure device 230, the charge roller 23, the development apparatus 25 and the primary transfer roller 26) that are arranged close to and around the photosensitive drum 22 and that act on the photosensitive drum 22 will be called image formation process means. The pre-exposure device 230 and the charge roller 23 will be called first image formation process means, and the development apparatus 25 and the primary transfer roller 26 will be called second image formation process means.

Meanwhile, a resist sensor not illustrated detects a tip position of a recording material 12 drawn out by a pickup roller 13, and the conveyance is temporarily stopped at a position where the tip has slightly passed a pair of conveyance rollers 14 and 15.

Rollers 31, 32 and 33 rotate and drive the intermediate transfer belt 30, and the intermediate transfer belt 30 conveys the toner image to the position of a secondary transfer roller 27. At this point, the conveyance of the recording material 12 is restarted to adjust the timing with the toner image conveyed by the intermediate transfer belt 30 at the position of the secondary transfer roller 27. The secondary transfer roller 27 transfers the toner image from the intermediate transfer belt 30.

Subsequently, a pair of fixation rollers 16 and 17 heat and fix the toner image of the recording material 12, and the recording material 12 is discharged outside of the apparatus. Remaining toners not transferred by the secondary transfer roller 27 from the intermediate transfer belt 30 to the recording material 12 are collected in a disposal toner container 36 by a cleaning blade 35. Operation of a misregistration detection sensor 40 will be described later. In this specification, "misregistration" implies misregistration of images with regard to each color.

<Configuration of High-Voltage Power Apparatus>

A configuration of a high-voltage power apparatus 41 will be described with reference to FIG. 2. The high-voltage power apparatus 41 includes charge high-voltage power circuits 43*a* to 43*d*, development high-voltage power circuits 44*a* to 44*d*, primary transfer high-voltage power circuits 46*a* to 46*d* and a secondary transfer high-voltage circuit 48.

The charge high-voltage power circuits 43*a* to 43*d* apply voltages to the charge rollers 23*a* to 23*d* to form background potentials on the surfaces of the photosensitive drums 22*a* to 22*d* to allow formation of the electrostatic latent images by emission of the laser beam 21. The development high-voltage power circuits 44*a* to 44*d* apply voltages to the developing sleeves 24*a* to 24*d* to put the toners over the electrostatic latent images of the photosensitive drums 22*a* to 22*d* to form the toner images.

The primary transfer high-voltage power circuits 46*a* to 46*d* apply voltages to the primary transfer rollers 26*a* to 26*d* to transfer the toner images of the photosensitive drums 22*a* to 22*d* to the intermediate transfer belt 30. The secondary transfer high-voltage power circuit 48 applies a voltage to the secondary transfer roller 27 to transfer the toner images of the intermediate transfer belt 30 to the recording material 12. The charge high-voltage power circuits 43*a* to 43*d* include current detection circuits 50*a* to 50*d* connected to the charge rollers 23*a* to 23*d*. The current detection circuit 50 detects the current flowing between the charge roller 23 and the photosensitive drum 22 to detect a change in the surface potential of the photosensitive drums 22*a* to 22*d* due to formation of an electrostatic latent image patch 80 for detection described later.

The primary transfer high-voltage power circuits 46*a* to 46*d* include current detection circuits 47*a* to 47*d*. The transfer performance of the toner images in the primary transfer rollers 26*a* to 26*d* changes according to the amount of current flowing through the primary transfer rollers 26*a* to 26*d*. Bias voltages (high voltages) applied to the primary transfer rollers 26*a* to 26*d* are adjusted according to detection results of the current detection circuits 47*a* to 47*d* to maintain the transfer performance even if the temperature or humidity changes in the apparatus. Constant voltage control is performed during the primary transfer to target a bias voltage that is set to adjust the amount of current flowing through the primary transfer rollers 26*a* to 26*d* to a target value.

<Summary of Misregistration Correction Control>

When the image formation is performed, for example, the velocity of the intermediate transfer belt 30, the emission position on the photosensitive drum 22 of the laser beam 21 emitted from the laser scanner unit 20, and pitches between the photosensitive drums 22 vary. Due to the variations, the way the toner images overlap varies when the toner images formed on the photosensitive drums 22*a* to 22*d* are placed on top of each other on the intermediate transfer belt 30. In some cases, a misregistration occurs in the formed image due to the various variations.

Therefore, the image forming apparatus detects the variations to perform correction corresponding to the variations to prevent the misregistration.

Usually, in the misregistration correction by the image forming apparatus, toner images are formed on the surfaces of the photosensitive drums 22*a* to 22*d*. The toner images as patterns 400, 401, 402 and 403 for misregistration detection are transferred to the surface of the intermediate transfer belt 30, and the detection sensor (FIG. 1) facing the intermediate transfer belt 30 detects the patterns 400, 401, 402 and 403. Based on the detection results, the emission start timing of the laser beam 21 from the laser scanner unit 20 are corrected in the image formation.

In the present embodiment, misregistration correction using the charge roller 23 is performed to particularly handle the variation in the emission position on the photosensitive drum 22 of the laser beam 21 emitted from the laser scanner unit 20, in addition to the misregistration correction using the detection sensor 40.

The misregistration correction using the charge roller 23 will be described. A laser beam 21 output from the laser scanner unit 20 is emitted (exposed) at an exposing position E illustrated in FIG. 3A to the surface of the photosensitive drum 22 charged by the charge roller 23 to form the electrostatic latent image patch 80, which serves as an electrostatic latent image for detection illustrated in FIG. 13, on the surface of the photosensitive drum 22. In the present embodiment, the electrostatic latent image patch 80 is formed in a horizontal band shape, with 30 dots (about 1.2 mm) in the circumferential direction of the photosensitive drum 22 that is the vertical scanning direction and with a length of 300 mm in the axial direction of the photosensitive drum that is the main scanning direction. Obviously, the surface potential of the section where the electrostatic latent image patch 80 is formed on the surface of the photosensitive drum 22 and the surface potential of other sections are different.

The electrostatic latent image patch 80 formed on the surface of the photosensitive drum 22 is changed along with the rotation of the photosensitive drum 22. The current detection circuit 50 detects a change in the current flowing between the photosensitive drum 22 and the charge roller 23 at a charging position where the charge roller 23 is arranged, which is a predetermined detecting position D provided around the photosensitive drum 22, as a result of the arrival of the electrostatic latent image patch 80 at the charging position. More specifically, the current detection circuit 50 detects the difference between the potential of the section where the electrostatic latent image patch 80 is formed on the surface of the photosensitive drum 22 and the potential of the other sections as a change in the current flowing between the photosensitive drum 22 and the charge roller 23.

Figure 3A:
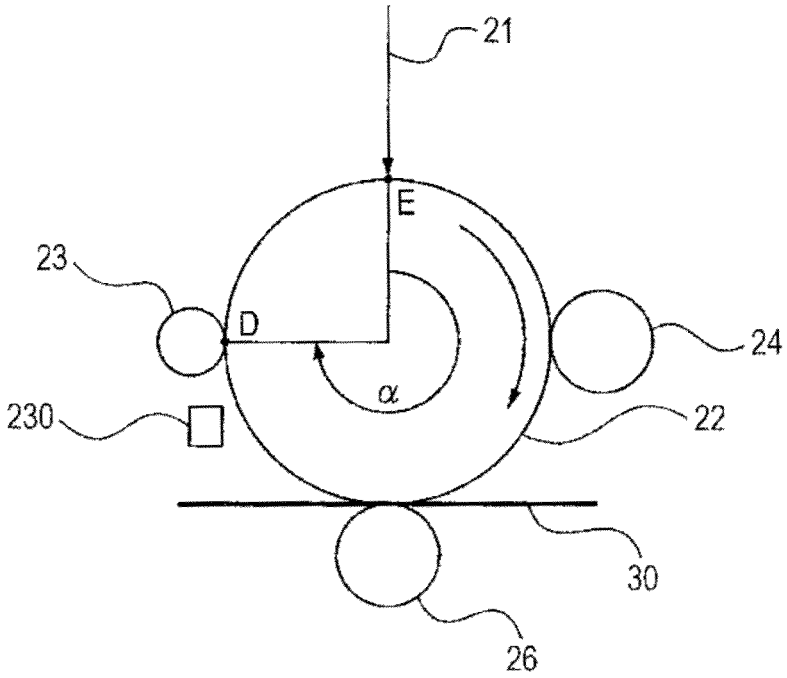
FIG. 3A is a diagram illustrating an exposing position by exposure means and a detecting position of an electrostatic latent image for detection according to the first embodiment.

In this way, as illustrated in FIG. 3A, the electrostatic latent image patch 80 is formed at the exposing position E, and the electrostatic latent image patch 80 is detected at the detecting position D as the charging position. The time interval between the departure from the exposing position E and the arrival at the detecting position D as the charging position opposing the charge roller 23 is measured. The emission start timing of the laser beam 21 from the laser scanner unit 20 is corrected during the image formation based on how much the measured time interval is changed from a reference time interval.

In the present embodiment, the charge roller 23 as charge means and the current detection circuit 50 function as a detector for detecting the arrival of the electrostatic latent image patch 80. The charge roller 23 as charge means sets the detecting position D, which is for detection of the arrival of the electrostatic latent image patch 80 for detection by the detector, to the charging position for charging the surface of the photosensitive drum 22.

<Gear Configuration of Drive System of Photosensitive Drum>

FIG. 3A illustrates an arrangement of image formation process components, such as the photosensitive drum 22, the laser scanner unit 20 and the charge roller 23, of the image forming apparatus 10 in FIG. 1. The arrangement is common to the four colors indicated by the photosensitive drums 22*a* to 22*d* of FIG. 1.

In FIG. 3A, the developing sleeve 24, the intermediate transfer belt 30, the primary transfer roller 26, the pre-exposure device 230 and the charge roller 23 are arranged around the photosensitive drum 22.

In the present embodiment, a rotation angle $\alpha$ of the photosensitive drum 22 from the exposing position E on the surface of the photosensitive drum 22 emitted by the laser beam 21 to the detecting position D where the charge roller 23 comes in contact is 270 degrees as illustrated in FIG. 3A.

Figure 3B:
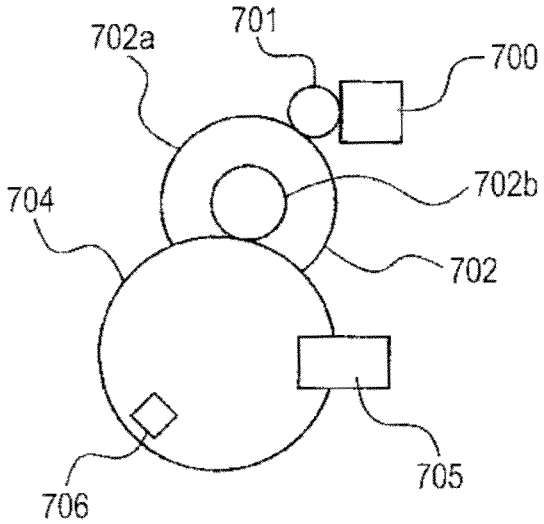
FIG. 3B is a drive configuration diagram from a motor to a photosensitive member gear arranged on a photosensitive drum.

FIG. 3B illustrates a configuration of a drive unit that drives the photosensitive drum 22.

A motor gear 701 is fixed to a drive shaft of a motor 700 as a drive source. A large diameter gear 702*a* of an idler stage gear 702 is meshed with the motor gear 701. A photosensitive member gear 704 that is engaged with the photosensitive drum 22 through a joint coupling not illustrated to transmit driving force is meshed with a small diameter gear 702*b* of the idler stage gear 702.

In this way, the rotation driving force of the motor 700 is transmitted to the photosensitive drum 22 through the motor gear 701, the idler stage gear 702 and the photosensitive member gear 704. The photosensitive drum 22 can be attached to and detached from the main body of the image forming apparatus 10 and is arranged on the same axis as that of the photosensitive member gear 704 in the image forming apparatus 10. The photosensitive drum 22 is engaged with the photosensitive member gear 704 through the joint coupling not illustrated to input the drive to rotate integrally with the photosensitive member gear 704.

A home position flag 706 for detecting the phase is arranged on the photosensitive member gear 704 and a home position sensor 705 can monitor one rotation cycle of the photosensitive member gear 704.

In the detection of the electrostatic latent image patch 80 by the charge roller 23, the velocity of the surface of the rotating photosensitive drum 22 is not always constant, and velocity variations occur.

Major factors of the velocity variations of the surface of the photosensitive drum 22 include accuracy errors and error of outer diameters of the motor gear 701, the idler stage gear 702 and the photosensitive member gear 704 that form the drive transmission gears from the motor 700 to the photosensitive drum 22 as illustrated in FIG. 3B. As a result, apparent radii of the gears vary depending on the rotation angle, and the velocity variations occur.

A drive configuration of the drive transmission gears from the motor 700 to the photosensitive drum 22 according to the present embodiment will be described.

Figure 18:
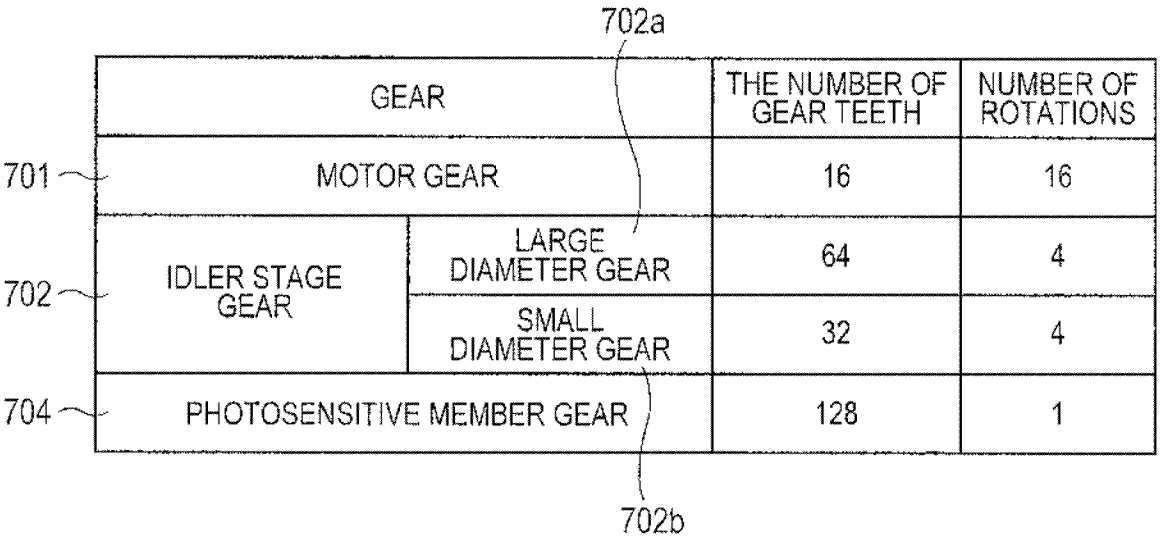
FIG. 18 is a diagram illustrating a specific example of the numbers of gear teeth and the numbers of rotations of the motor gear, the idler stage gear and the photosensitive member gear of the first embodiment illustrated in FIG. 3B.

As illustrated in FIG. 18, the idler stage gear 702 rotates four times while the photosensitive member gear 704 fixed to the photosensitive drum 22 rotates once. The motor gear 701 rotates 16 times.

Figure 4A:
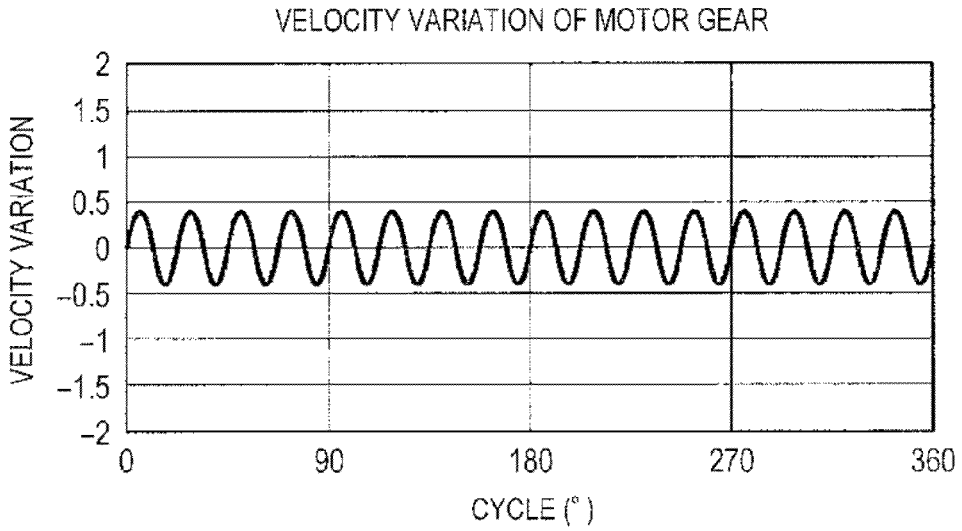
FIG. 4A is a diagram illustrating a velocity variation (amplitude) of a motor gear in one rotation of the photosensitive drum caused by backlash according to the first embodiment.
Figure 4B:
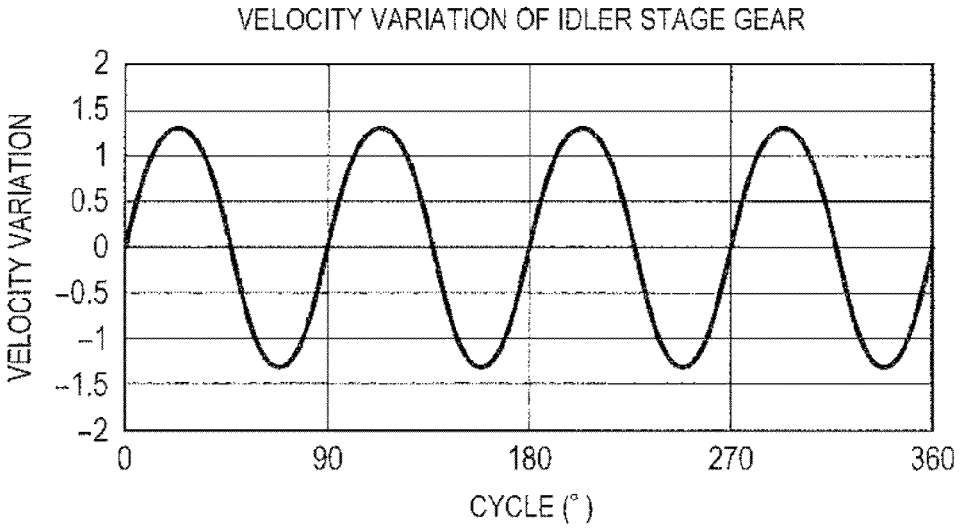
FIG. 4B is a diagram illustrating a velocity variation (amplitude) of an idler stage gear generated in one rotation of the photosensitive drum caused by backlash according to the first embodiment.

In the present embodiment, it is assumed that the position variation on the surface of the photosensitive drum 22 due to the backlash (looseness between tooth surfaces) is about 18 μm when the gears are created by the equivalent of grade 2 of JGMA (Japan Gear Manufacturers Association). Assuming that the velocity variation (amplitude) in this case is 1, the velocity variation (amplitude) in the motor gear 701 caused by one rotation of the photosensitive drum 22 is 0.4 in 16 cycles as illustrated in FIG. 4A. The velocity variation (amplitude) in the idler stage gear 702 caused by one rotation of the photosensitive drum 22 is 1.3 in four cycles as illustrated in FIG. 4B.

The apparent radius of the photosensitive member gear 704 at the section meshed with the idler stage gear 702 is changed by the accuracy error or the error of outer diameter of the photosensitive member gear 704, with one rotation of the photosensitive member gear 704 as one cycle. Therefore, the velocity of the photosensitive drum 22 varies even if there is no velocity variation in the drive transmission gears. The velocity variation (amplitude) of the photosensitive drum 22 is 1 in one cycle.

Therefore, assuming that one rotation of the photosensitive drum 22 is one cycle, velocity variations including the velocity variation of the motor gear 701 with 1/16 cycle, the velocity variation of the idler stage gear 702 with 1/4 cycle, and the velocity variation of the photosensitive member gear 704 with 1 cycle are generated on the photosensitive drum 22.

The velocity variation at the exposing position E and the velocity variation at the detecting position D of the electrostatic latent image patch 80 at the predetermined position on the surface of the photosensitive drum 22 may be different. In this case, the time interval from the exposing position E to the arrival at the detecting position D of the electrostatic latent image patch 80 varies depending on where the electrostatic latent image patch 80 is formed.

Therefore, the difference between the velocity variation at the exposing position E and the velocity variation at the detecting position D of the electrostatic latent image patch 80 depicted at the predetermined position on the surface of the photosensitive drum 22 is taken into account in the present embodiment. The velocity variations of the motor gear 701 and the idler stage gear 702 are cancelled from the difference.

The velocity variation of the photosensitive member gear 704 will be described. As illustrated in FIG. 3A, in the detection of the electrostatic latent image patch 80 for detection depicted on the surface of the photosensitive drum 22 at the detecting position D opposing the charge roller 23, the electrostatic latent image patch is detected at a position 270 degrees in the rotation direction of the photosensitive drum 22, wherein the exposing position E is 0 degree.

Therefore, the apparent radius of the photosensitive member gear 704 at the section meshed with the idler stage gear 702 when the electrostatic latent image patch 80 depicted at the predetermined position on the surface of the photosensitive drum 22 is at the exposing position E and the apparent radius when the electrostatic latent image patch 80 is at the detecting position D are different.

As a result, the velocity variation of the section of the photosensitive drum 22 with the drawing of the electrostatic latent image patch 80 when the electrostatic latent image patch 80 passes through the exposing position E and the velocity variation when the electrostatic latent image patch 80 passes through the detecting position D are different. The velocity variation of the photosensitive drum 22 when the electrostatic latent image patch 80 passes through the exposing position E and the velocity variation of the photosensitive drum 22 when the electrostatic latent image patch 80 passes through the detecting position D vary depending on which position (polar coordinate point) on the surface of the photosensitive drum 22 the electrostatic latent image patch 80 is depicted.

A relationship between each point (each polar coordinate point) on the surface of the photosensitive drum 22 and the difference between the velocity variation of the photosensitive drum 22 when each point passes through the exposing position E and the velocity variation of the photosensitive drum 22 when each point passes through the detecting position D will be described.

Figure 5A:
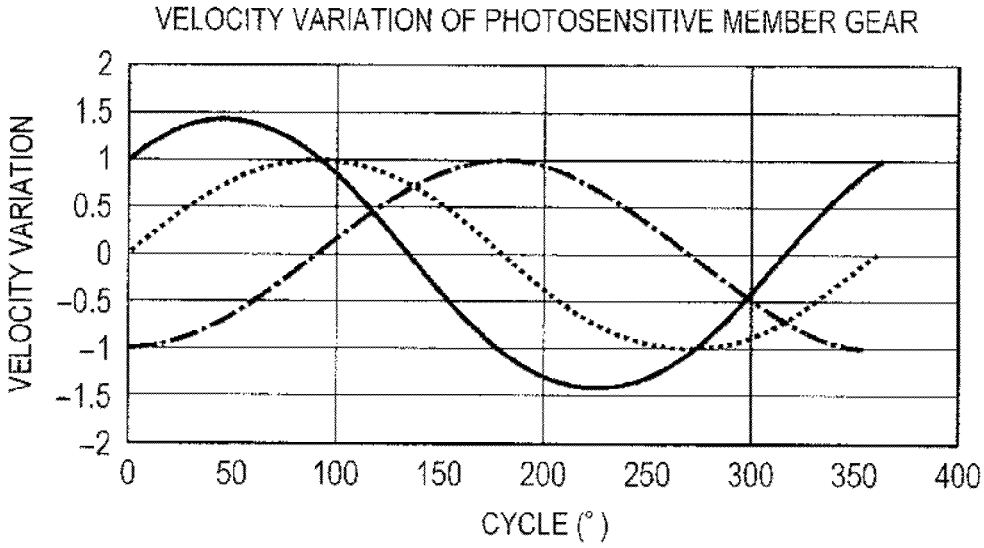
FIG. 5A is a graph illustrating a position on a surface of the photosensitive drum in one cycle based on the backlash on a horizontal axis and illustrating a velocity variation on a vertical axis according to the first embodiment.

FIG. 5A is a graph depicting the position on the surface of the photosensitive drum 22 in one cycle on the horizontal axis and depicting the velocity variation on the vertical axis. The velocity variation when each point (each polar coordinate point) on the surface of the photosensitive drum 22 passes through the exposing position E is illustrated by a chain line. Meanwhile, the velocity variation when each point on the surface of the photosensitive drum 22 passes through the detecting position D is illustrated by an alternate long and short dash line. The reason that the phases of the chain line and the alternate long and short dash line are deviated by 270° (3/4 cycle) is that each point on the surface of the photosensitive drum 22 rotates 270° after passing through the exposing position E to pass through the detecting position D.

The velocity variation of the electrostatic latent image patch 80 for detection on the surface of the photosensitive drum 22 is a difference between the velocity variation at the exposing position E and the velocity variation at the detecting position D, and the velocity variation is illustrated by a solid line of FIG. 5A.

The velocity variation of the electrostatic latent image patch 80 for detection on the surface of the photosensitive drum 22 is a difference between the velocity variation at the exposing position E and the velocity variation at the detecting position D. The phase of the velocity variation at the detecting position D is deviated by ¾ cycle, or 270 degrees.

Figure 5B:
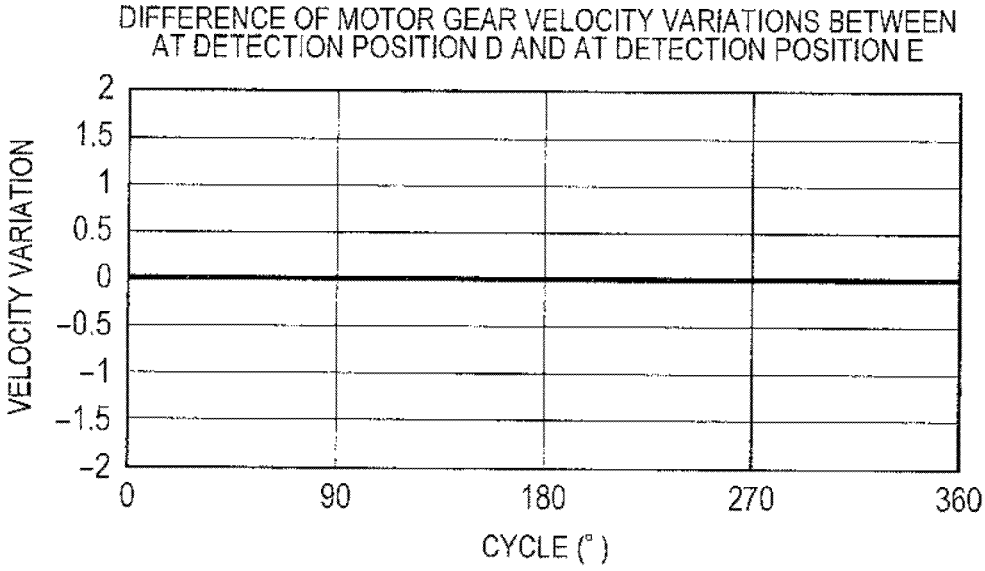
FIG. 5B is a diagram illustrating that the difference between the cycle of the motor gear at the exposing position and the cycle at the detecting position is 0 according to the first embodiment.

The velocity variation of the motor gear 701 among the velocity variations of the photosensitive drum 22 will be described. In the motor gear 701, the velocity variation at the detecting position D is delayed (deviated) by ¾ cycle from the velocity variation at the exposing position E. Therefore, assuming that the velocity variation at the exposing position E is a component of a first rotation of the motor 700, the velocity variation at the detecting position D upon the arrival at the charge roller 23 is a component of a thirteenth rotation of the motor 700. More specifically, the velocity variations at the exposing position E and the detecting position D are in the same phase, and regarding the velocity variation of the motor gear 701 as illustrated in FIG. 5B, the difference between the velocity variation of the motor gear 701 at the exposing position E and the velocity variation at the detecting position D (velocity variation where the phase is deviated by ¾ cycle, or 270 degrees) is 0.

Therefore, the motor gear (rotation member) 701 rotates an integer number of times while the photosensitive drum 22 rotates from the exposing position E to the detecting position D. In this way, the variation in the rotation velocity of the surface of the photosensitive drum 22 caused by the accuracy error or error of outer diameter of the motor gear 701 does not have to be taken into account.

Figure 6A:
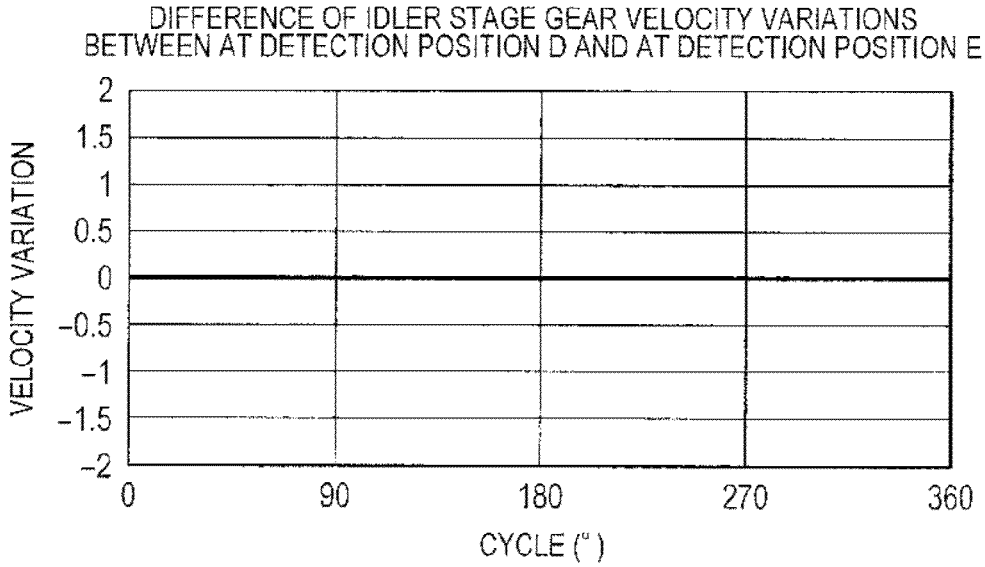
FIG. 6A is a diagram illustrating that the difference between the cycle of the idler stage gear at the exposing position and the cycle at the detecting position is 0 according to the first embodiment.

The velocity variation of the idler stage gear 702 at the detecting position D is also delayed (deviated) by ¾ cycle from the velocity variation at the exposing position E. Therefore, assuming that the velocity variation at the exposing position E is a component of the first rotation of the motor 700, the velocity variation at the detecting position D upon the arrival at the charge roller 23 is a component of a fourth rotation of the motor 700. More specifically, the velocity variations at the exposing position E and the detecting position D are in the same phase, and as illustrated in FIG. 6A, the difference between the velocity variation at the exposing position E and the velocity variation at the detecting position D (velocity variation where the phase is deviated by ¾ cycle, or 270 degrees) is 0.

Therefore, the idler stage gear (rotation member) 702 rotates an integer number of times while the photosensitive drum 22 rotates from the exposing position E to the detecting position D. In this way, the variation in the rotation velocity of the surface of the photosensitive drum 22 caused by the accuracy error or error of outer diameter of the idler stage gear 702 does not have to be taken into account.

Figure 6B:
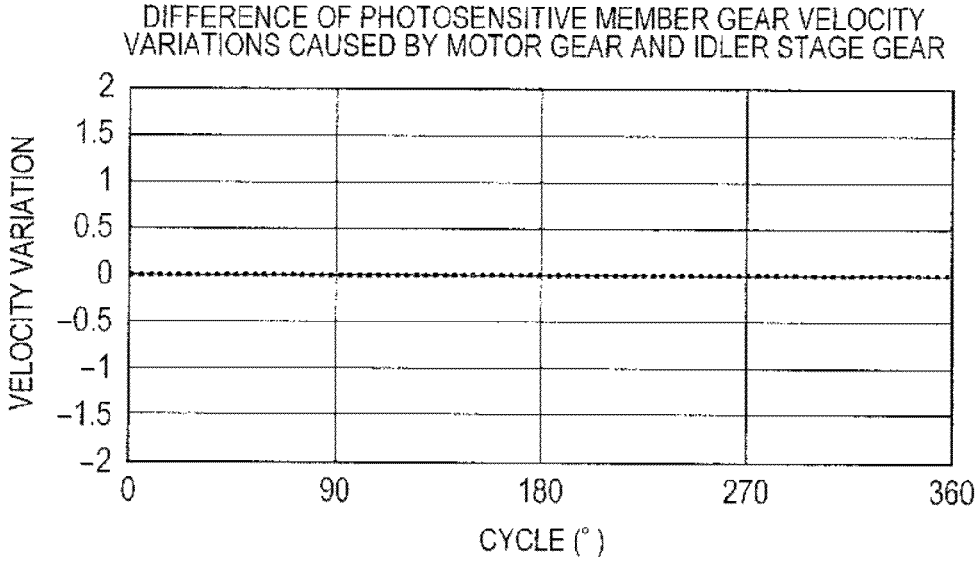
FIG. 6B is a diagram illustrating that the difference between the cycle of the sum of the velocity variations of the motor gear and an idler stage gear at the exposing position and the cycle at the detecting position is 0 according to the first embodiment.

According to the configuration, the detected components on the photosensitive member gear 704 are eventually as illustrated in FIG. 6B. A sum of the velocity variations (amplitudes) caused by the motor gear 701 and the idler stage gear 702 is 0. Meanwhile, the velocity variation (amplitude) caused by the single photosensitive member gear 704 (velocity variation of the surface of the photosensitive drum 22 caused by the accuracy error or the error of outer diameter of the photosensitive member gear 704) is taken into account at the detection of the electrostatic latent image patch 80 for detection.

Therefore, as illustrated in FIG. 3B, the photosensitive member gear 704 includes the home position flag 706, and the home position sensor 705 detects one rotation cycle of the photosensitive member gear 704.

The detection of the electrostatic latent image patch 80 is based on a waveform always detected by the home position sensor 705. The electrostatic latent image patch is depicted at a position with the same polar coordinates on the surface of the photosensitive drum 22, i.e. a position on the surface of the photosensitive drum 22 with the same phase on the photosensitive member gear 704. The velocity variation (amplitude) caused by the single photosensitive member gear 704 can be cancelled by subtracting the velocity variation (amplitude) of the photosensitive member gear 704 generated between the electrostatic latent image patches 80 depicted every certain time.

According to the configuration, the electrostatic latent image patch 80 can be accurately detected.

A detection error when the detecting position D where the charge roller 23 is arranged is deviated more than the position of 270 degrees in the rotation direction of the photosensitive drum 22 relative to the exposing position E will be described.

As an example, velocity variations of the gears and the detection errors caused by the velocity variations when the detecting position D where the charge roller 23 is arranged is at a position of 277 degrees, which is 7 degrees more deviated than the position of 270 degrees, in the rotation direction of the photosensitive drum 22 relative to the exposing position E will be described.

Figure 7A:
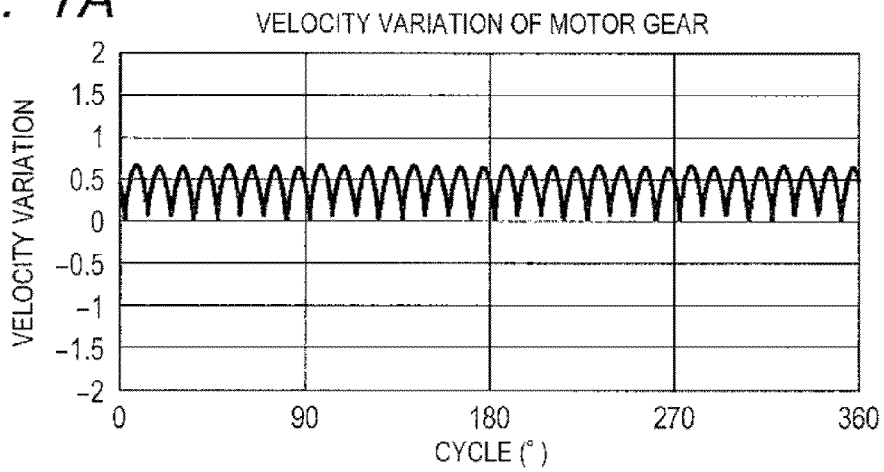
FIG. 7A is a diagram illustrating a velocity variation of the motor gear in one rotation of the photosensitive drum when the exposing position by the exposure means and the detecting position of the electrostatic latent image for detection are at positions of 277 degrees according to the first embodiment.

FIG. 7A illustrates a velocity variation of the motor gear 701 caused by one rotation of the photosensitive drum 22. In the present embodiment, from the exposing position E by the laser scanner unit 20 to the detecting position D of the electrostatic latent image patch 80 for detection is at the position of 277 degrees in the rotation direction of the photosensitive drum 22. The phase deviation is 7 degrees greater than the 270 degrees illustrated in FIG. 3A.

In the graph illustrated in FIG. 7A, the velocity variation (amplitude) of the motor gear 701 is ΔVm, and the rotation angle of the photosensitive member gear 704 is θ. As illustrated in FIG. 4A, the velocity variation (amplitude) in the motor gear 701 caused by one rotation of the photosensitive drum 22 is 0.4. In this case, the velocity variation (amplitude) ΔVm of the motor gear 701 is expressed by the following Expression 1.

$$\Delta Vm=|0.4\times\{\sin(\theta)-\sin(277°)\}| \quad \text{Expression 1}$$

Figure 7B:
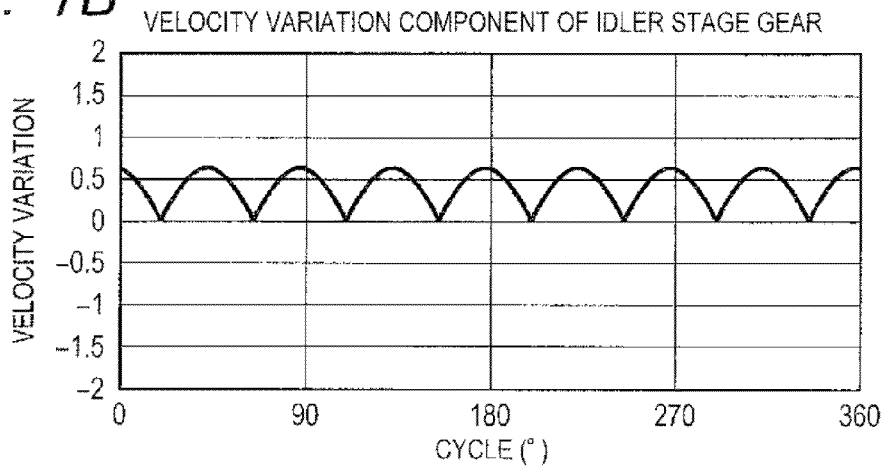
FIG. 7B is a diagram illustrating a velocity variation of the idler stage gear in one cycle of the photosensitive drum when the exposing position by the exposure means and the detecting position of the electrostatic latent image for detection are at positions of 277 degrees.

FIG. 7B illustrates a velocity variation of the idler stage gear 702 caused by one rotation of the photosensitive drum 22. In the present embodiment, from the exposing position E by the laser scanner unit 20 to the detecting position D of the electrostatic latent image patch 80 for detection is at the position of 277 degrees in the rotation direction of the photosensitive drum 22. The phase deviation is 7 degrees greater than the 270 degrees illustrated in FIG. 3A.

In the graph illustrated in FIG. 7B, the velocity variation (amplitude) of the idler stage gear 702 is ΔVi, and the rotation angle of the photosensitive member gear 704 is θ. As illustrated in FIG. 4B, the velocity variation (amplitude) in the idler stage gear 702 caused by one rotation of the photosensitive drum 22 is 1.3. In this case, the velocity variation (amplitude) ΔVi of the idler stage gear 702 is expressed by the following Expression 2.

$$\Delta Vi=|1.3\times\{\sin(\theta)-\sin(277°)\}| \quad \text{Expression 2}$$

Figure 7C:
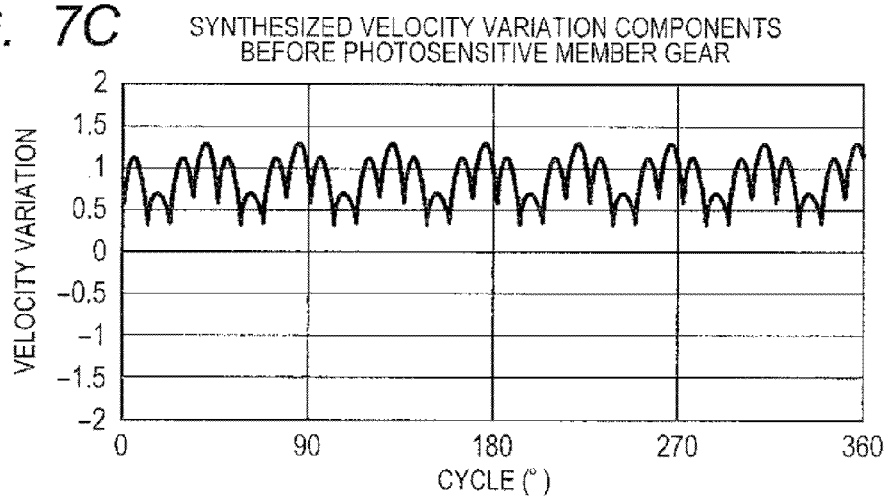
FIG. 7C is a diagram illustrating a velocity variation of the sum of the velocity variations of the motor gear and the idler stage gear in one rotation of the photosensitive drum when the exposing position by the exposure means and the detecting position of the electrostatic latent image for detection are at positions of 277 degrees.

A sum of maximum values of the velocity variations (amplitudes) of the motor gear 701 and the idler stage gear 702 illustrated in FIGS. 7A and 7B is generated in the photosensitive member gear 704 as illustrated in FIG. 7C. FIG. 7C depicts synthesis of the velocity variations (amplitudes) of the motor gear 701 and the idler stage gear 702 illustrated in FIGS. 7A and 7B. This serves as a maximum velocity variation (amplitude) of the drive transmission gears from the motor 700 to the photosensitive drum 22, and the maximum velocity variation (amplitude) Vmax in this case is expressed by the following Expression 3 from the graph of FIG. 7C.

$$Vmax \approx 1.2 \quad \text{Expression 3}$$

As a result, a position variation ΔSd on the surface of the photosensitive drum 22 is expressed by the following Expression 4.

$$\Delta Sd \approx 18\ \mu m \times Vmax = 18 \times 1.2 \approx 21\ \mu m \quad \text{Expression 4}$$

More specifically, the photosensitive drum 22 rotates from the exposing position E where the laser beam 21 is emitted by the laser scanner unit 20 to the detecting position D opposing the charge roller 23. If the phase difference in the rotation angle between the photosensitive member gear 704 fixed to the photosensitive drum 22 during the rotation and the idler stage gear 702 is seven degrees, the maximum detection error of about 21 μm may occur on the surface of the photosensitive drum 22.

As another example, velocity variations of the gears and the detection errors caused by the velocity variations when the detecting position D where the charge roller 23 is arranged is at a position of 295 degrees, which is 25 degrees more deviated than the position of 270 degrees, in the rotation direction of the photosensitive drum 22 relative to the exposing position E will be described.

Figure 8A:
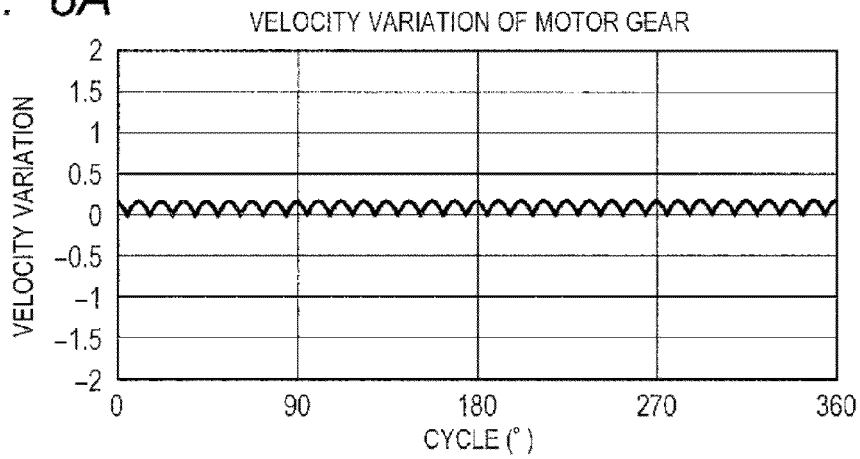
FIG. 8A is a diagram illustrating a velocity variation of the motor gear in one rotation of the photosensitive drum when the exposing position by the exposure means and the detecting position of the electrostatic latent image for detection are at positions of 295 degrees according to the first embodiment.

FIG. 8A illustrates a velocity variation of the motor gear 701 caused by one rotation of the photosensitive drum 22. In the present embodiment, from the exposing position E by the laser scanner unit 20 to the detecting position D of the electrostatic latent image patch 80 for detection is at the position of 295 degrees in the rotation direction of the photosensitive drum 22. The phase deviation is 25 degrees greater than the 270 degrees illustrated in FIG. 3A.

In the graph illustrated in FIG. 8A, the velocity variation (amplitude) of the motor gear 701 is ΔVm, and the rotation angle of the photosensitive member gear 704 is θ. As illustrated in FIG. 4A, the velocity variation (amplitude) in the motor gear 701 caused by one rotation of the photosensitive drum 22 is 0.4. In this case, the velocity variation (amplitude) ΔVm of the motor gear 701 is expressed by the following Expression 5.

$$\Delta Vm = |0.4 \times \{\sin(\theta) - \sin(295°)\}| \quad \text{Expression 5}$$

Figure 8B:
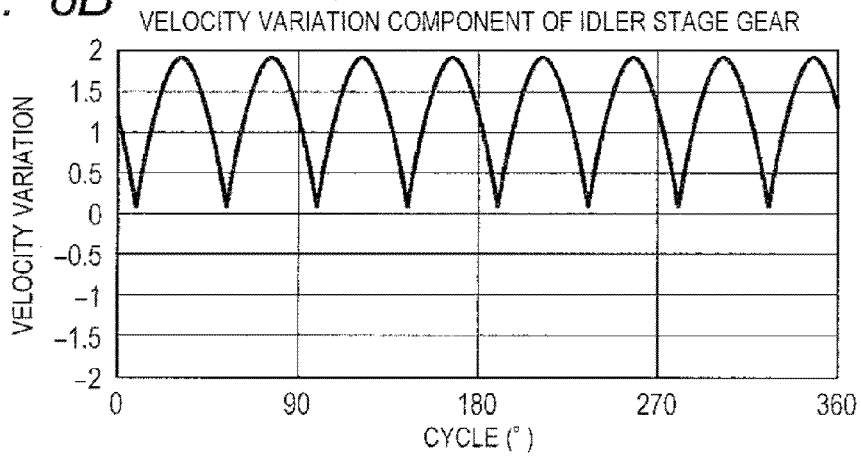
FIG. 8B is a diagram illustrating a velocity variation of the idler stage gear in one rotation of the photosensitive drum when the exposing position by the exposure means and the detecting position of the electrostatic latent image for detection are at positions of 295 degrees.

FIG. 8B illustrates a velocity variation of the idler stage gear 702 caused by one rotation of the photosensitive drum 22. In the present embodiment, from the exposing position E by the laser scanner unit 20 to the detecting position D of the electrostatic latent image patch 80 for detection it is at the position of 295 degrees in the rotation direction of the photosensitive drum 22. The phase deviation is 25 degrees greater than the 270 degrees illustrated in FIG. 3A.

In the graph illustrated in FIG. 8B, the velocity variation (amplitude) of the idler stage gear 702 is ΔVi, and the rotation angle of the photosensitive member gear 704 is θ. As illustrated in FIG. 4B, the velocity variation (amplitude) in the idler stage gear 702 caused by one rotation of the photosensitive drum 22 is 1.3. In this case, the velocity variation (amplitude) ΔVi of the idler stage gear 702 is expressed by the following Expression 6.

$$\Delta Vi = |1.3 \times \{\sin(\theta) - \sin(295°)\}| \quad \text{Expression 6}$$

Figure 8C:
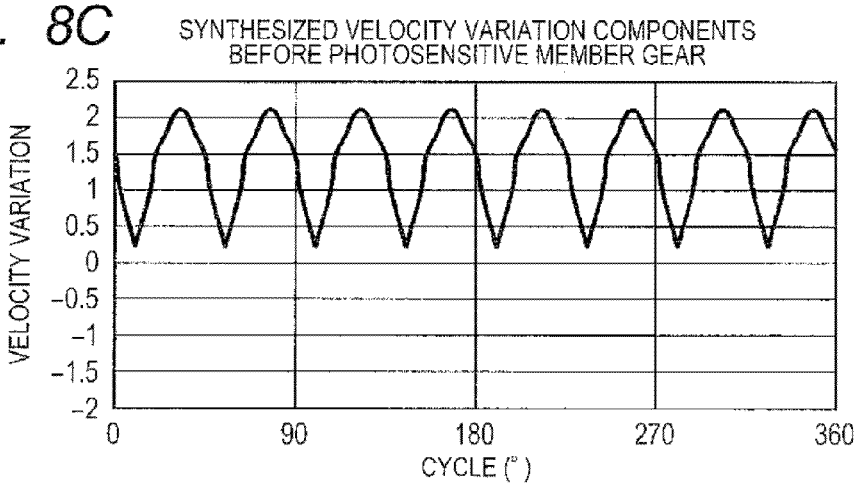
FIG. 8C is a diagram illustrating a velocity variation of a sum of the velocity variations of the motor gear and the idler stage gear in one rotation of the photosensitive drum when the exposing position by the exposure means and the detecting position of the electrostatic latent image for detection are at positions of 295 degrees.

A sum of maximum values of the velocity variations (amplitudes) of the motor gear 701 and the idler stage gear 702 illustrated in FIGS. 8A and 8B is generated in the photosensitive member gear 704 as illustrate in FIG. 8C. FIG. 8C depicts synthesis of the velocity variations (amplitudes) of the motor gear 701 and the idler stage gear 702 illustrated in FIGS. 8A and 8B. This serves as a maximum velocity variation (amplitude) of the drive transmission gears from the motor 700 to the photosensitive drum 22, and the maximum velocity variation (amplitude) Vmax in this case is expressed by the following Expression 7 from the graph of FIG. 8C.

$$Vmax \approx 2.3 \quad \text{Expression 7}$$

As a result, a position variation ΔSd on the surface of the photosensitive drum 22 is expressed by the following Expression 8.

$$\Delta Sd \approx 18\ \mu m \times Vmax \approx 41\ \mu m \quad \text{Expression 8}$$

More specifically, the photosensitive drum 22 rotates from the exposing position E where the laser beam 21 is emitted by the laser scanner unit 20 to the detecting position D opposing the charge roller 23. The phase difference in the rotation angle between the photosensitive member gear 704 fixed to the photosensitive drum 22 during the rotation and the idler stage gear 702 is 25 degrees. As a result, the maximum detection error of about 41 μm may occur on the surface of the photosensitive drum 22.

<Configuration of Control System>

Figure 9:
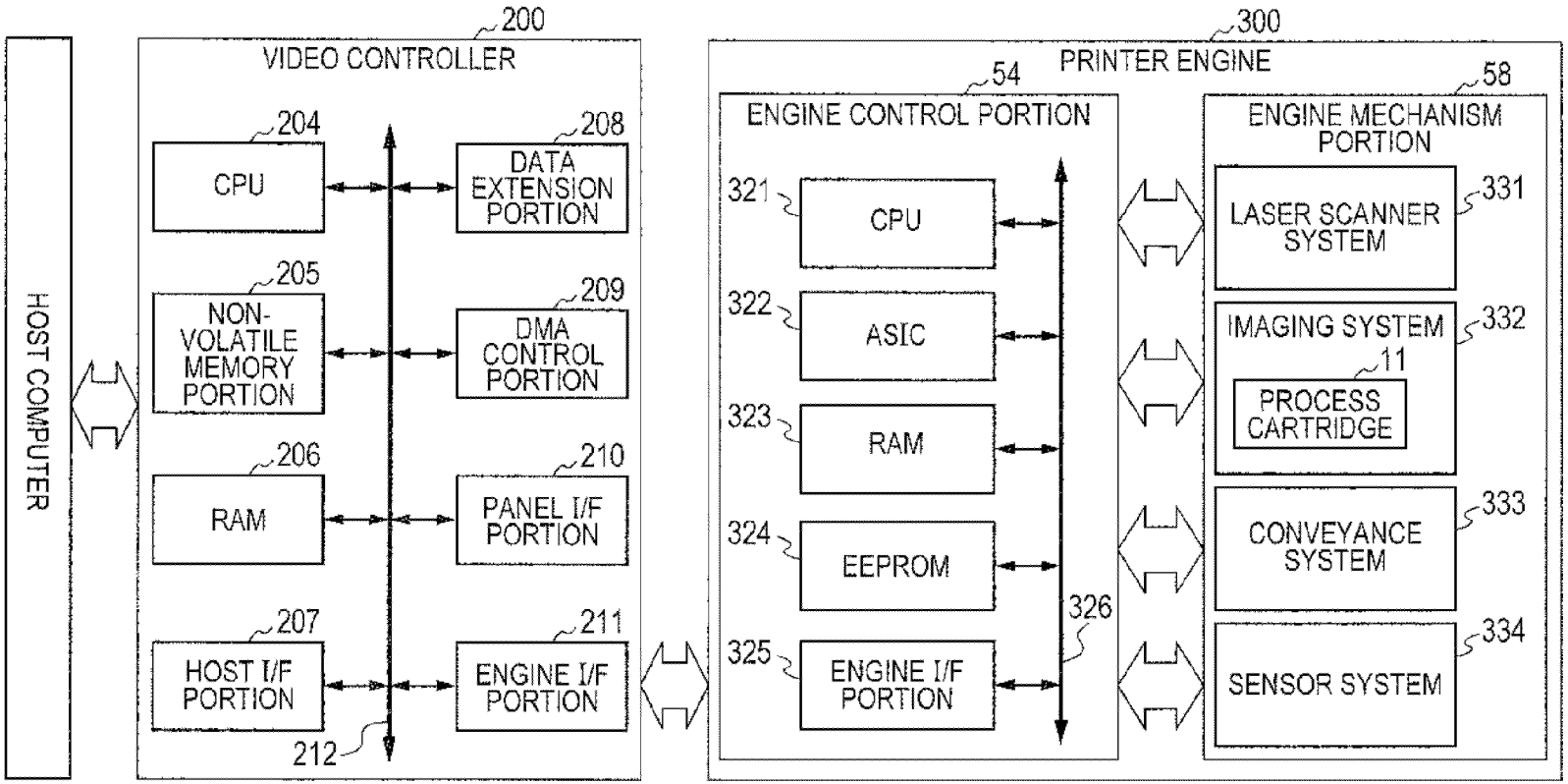
FIG. 9 is a block diagram illustrating a configuration of a control system arranged on an image forming apparatus.

A configuration of a control system of the image forming apparatus 10 will be described with reference to FIG. 9. In a video controller 200 of FIG. 9, a CPU (Central Processing Unit) 204 manages control of the entire video controller 200. A non-volatile memory portion 205 stores various control codes executed by the CPU 204.

This is equivalent to a ROM (Read Only Memory). Or, this is equivalent to an EEPROM (Electrically Erasable and Programmable Read Only Memory). Or, this is equivalent to a hard disk. A RAM (Random Access Memory) 206 for temporary storage functions as a main memory or a work area of the CPU 204.

A host I/F (interface) portion 207 is an input/output portion of print data and control data transmitted to and from an external device 100 such as a host computer. The printing data received by the host I/F portion 207 is stored in the RAM 206 as compressed data. A data extension portion 208 extends the compressed data. The data extension portion 208 extends arbitrary compressed data stored in the RAM 206 to image data, line by line. The extended image data is stored again in the RAM 206.

Reference numeral 209 denotes a DMA (Direct Memory Access) control portion. The DMA control portion 209 transmits the image data in the RAM 206 to an engine I/F (interface) portion 211 based on an instruction from the CPU 204. A panel I/F (interface) portion 210 receives settings and instructions from an operator from a panel portion arranged on the main body of the image forming apparatus 10.

The engine I/F portion 211 is an input/output portion of signals transmitted to and from a printer engine 300. The engine I/F portion 211 sends out a data signal from an output buffer register not illustrated and controls communication with the printer engine 300. A system bus 212 includes an address bus and a data bus. The constituent elements are connected to the system bus 212, and the constituent elements can access each other.

The printer engine 300 will be described. The printer engine 300 basically includes an engine control portion 54 and an engine mechanism portion 58. The engine mechanism portion 58 is a section that is operated by various instructions from the engine control portion 54.

<Engine Mechanism Portion>

A laser scanner system 331 arranged on the engine mechanism portion 58 includes a laser emitting element, a laser driver circuit, a scanner motor, a polygon mirror and a scanner driver that form the laser scanner unit 20. The laser scanner system 331 is a part that exposes and scans the photosensitive drum 22 by the laser beam 21 according to the image data transmitted from the video controller 200 to form the electrostatic latent image on the photosensitive drum 22.

An imaging system 332 is a section that serves as the center of the image forming apparatus 10 and is a part that forms, on the recording material 12 such as a sheet, a toner image based on an electrostatic latent image formed on the photosensitive drum 22. The imaging system 332 includes the image formation process means that acts on the photosensitive drum 22 as described above. The section called the image forming unit is defined in the description above, and the imaging system 332 is the section.

The imaging system 332 includes image formation process elements, such as a process cartridge in which the photosensitive drum 22, the charge roller 23 and the development apparatus 25 are integrated, and a fixation apparatus including the intermediate transfer belt 30 and the pair of fixation rollers 16 and 17. The imaging system 332 further includes a high-voltage power circuit that generates various biases (high voltages) for imaging. The imaging system 332 also includes, for example, a motor for driving the members, such as a motor for driving the photosensitive drum 22.

The integrated process cartridge includes an electricity removing device, the charge roller 23, the development apparatus 25 and the photosensitive drum 22. The process cartridge also includes a non-volatile memory tag. A CPU 321 or an ASIC (Application Specific Integrated Circuit; custom IC) 322 reads and writes various information to and from the memory tag.

A conveyance system 333 is a section that manages the conveyance of the recording material 12, and the conveyance system 333 includes various conveyance system motors, a conveyance tray, a discharge tray and various conveyance rollers.

A sensor system 334 is a sensor group that collects information necessary for the CPU 321 and the ASIC 322 described later to control the laser scanner system 331, the imaging system 332 and the conveyance system 333. The sensor group at least includes already known various sensors, such as a temperature sensor of the fixation apparatus including the pair of fixation rollers 16 and 17 and a density sensor that detects the density of an image. Although the sensor system 334 is separated from the laser scanner system 331, the imaging system 332 and the conveyance system 333 in FIG. 9, the sensor system 334 may be included in one of the systems.

<Engine Control Portion>

The engine control portion 54 will be described. The CPU 321 uses a RAM 323 as a main memory and a work area. The engine control portion 54 follows various control programs stored in an EEPROM (Electrically Erasable and Programmable Read Only Memory; flash memory) 324. The engine control portion 54 controls the engine mechanism portion 58.

More specifically, the CPU 321 drives the laser scanner system 331 based on a print control command and image data input from the video controller 200 through the engine I/F portion 211 and an engine I/F portion 325. A volatile memory with a backup battery may replace the non-volatile memory. The CPU 321 controls the imaging system 332 and the conveyance system 333 to control various print sequences. The CPU 321 drives the sensor system 334 to obtain information necessary to control the imaging system 332 and the conveyance system 333.

Meanwhile, the ASIC 322 controls various motors for executing various print sequences and performs high-voltage power control of development bias under instruction of the CPU 321. A system bus 326 includes an address bus and a data bus. The constituent elements of the engine control portion 54 are connected to the system bus 326, and the constituent elements can access each other. The ASIC 322 may perform part or all of the functions of the CPU 321, or conversely, the CPU 321 may perform part or all of the functions of the ASIC 322.

<High-Voltage Power Apparatus>

A configuration of the primary transfer high-voltage power circuit 46*a* in the high-voltage power apparatus 41 of FIG. 2 will be described with reference to FIG. 10. The primary transfer high-voltage power circuits 46*b* to 46*d* of the other colors have the same circuit configuration as that of the primary transfer high-voltage power circuit 46*a* illustrated in FIG. 10, and the description will not be repeated.

Figure 10:
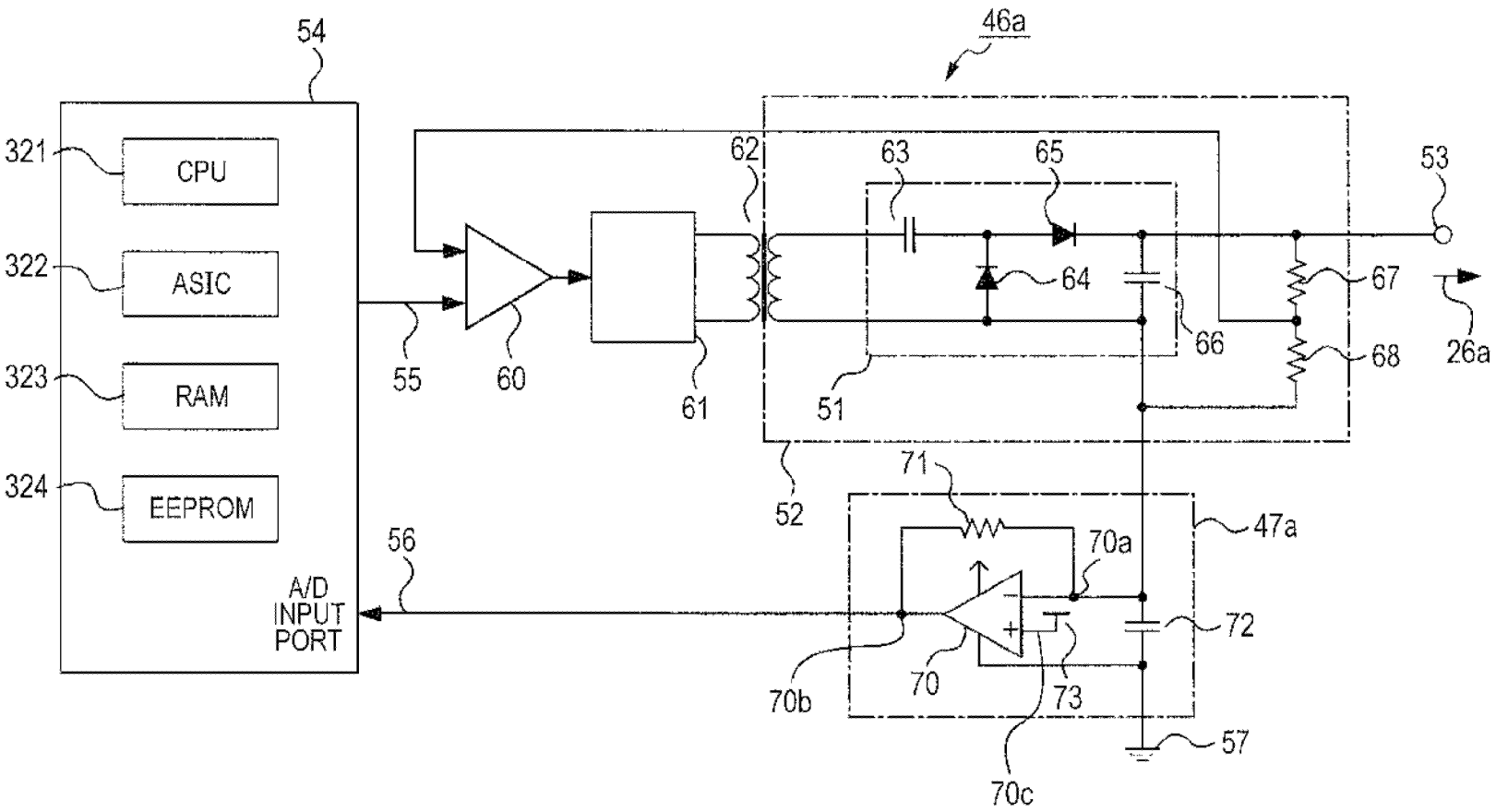
FIG. 10 is a diagram illustrating a configuration of a primary transfer high-voltage power circuit arranged on the high-voltage power apparatus of the image forming apparatus.

In FIG. 10, a transformer 62 pressures up the voltage of an AC signal generated by a drive circuit 61 to amplitude of several dozen times. A rectifier circuit 51 including diodes 64, 65, and capacitors 63 and 66 rectifies and smoothes the boosted AC signal. The rectified and smoothed voltage signal is output as a DC voltage to an output terminal 53. A comparator 60 controls the output voltage of the drive circuit 61 to equalize the voltage of the output terminal 53 divided by detection resistors 67 and 68 and a set voltage 55 set by the engine control portion 54. According to the voltage of the output terminal 53, a current flows through the primary transfer roller 26*a*, the photosensitive drum 22*a* and a ground point 57.

The current detection circuit 47*a* is inserted between a secondary circuit 52 of the transformer 62 and the ground point 57. The impedance of an input terminal of the operational amplifier 70 is high, and the current scarcely flows. Therefore, substantially all of the direct current flowing from the ground point 57 to the output terminal 53 through the secondary circuit 52 of the transformer 62 flows to a resistor 71.

An inverting input terminal 70*a* of the operational amplifier 70 is connected to an output terminal 70*b* through the resistor 71, and the inverting input terminal 70*a* is virtually grounded to a reference voltage connected to a non-inverting input terminal 70*c*. Therefore, a detection voltage 56 proportional to the amount of current flowing through the output terminal 53 emerges at the output terminal 70*b* of the operational amplifier 70. The capacitor 72 is configured to stabilize the inverting input terminal 70*a* of the operational amplifier 70.

The characteristics of the current are changed by factors, such as degree of degradation of various members and environment including in-device temperature. At timing before the toner image just after the start of printing reaches the primary transfer roller 26*a*, the engine control portion 54 measures the detection voltage 56 of the current detection circuit 47*a* at an A/D (analog/digital) input port. The engine control portion 54 sets the set voltage 55 to adjust the detection voltage 56 to a predetermined value. In this way, the transfer performance of the toner image can be maintained even if the surrounding temperature or humidity changes.

<Misregistration Correction Control Operation>

Latent image registration detection will be described. The electrostatic latent image patch 80 for detection is formed on the photosensitive drum 22 after exposure by the laser beam 21 emitted by the laser scanner unit 20. A measuring device included in the engine control portion 54 measures the time interval between the departure of the electrostatic latent image patch 80 for detection from the exposing position E and the arrival at the detecting position D opposing the charge roller 23. The time interval is preset as a reference time interval (reference time value) of the misregistration correction control. The measurement of the time interval by the measuring device denotes obtaining of a value corresponding to the time interval by measuring the number of times of output of the clock output at a predetermined frequency in a period from the formation of the electrostatic latent image patch 80 to the detection of the arrival of the electrostatic latent image patch 80 at the detecting position D.

Figure 12:
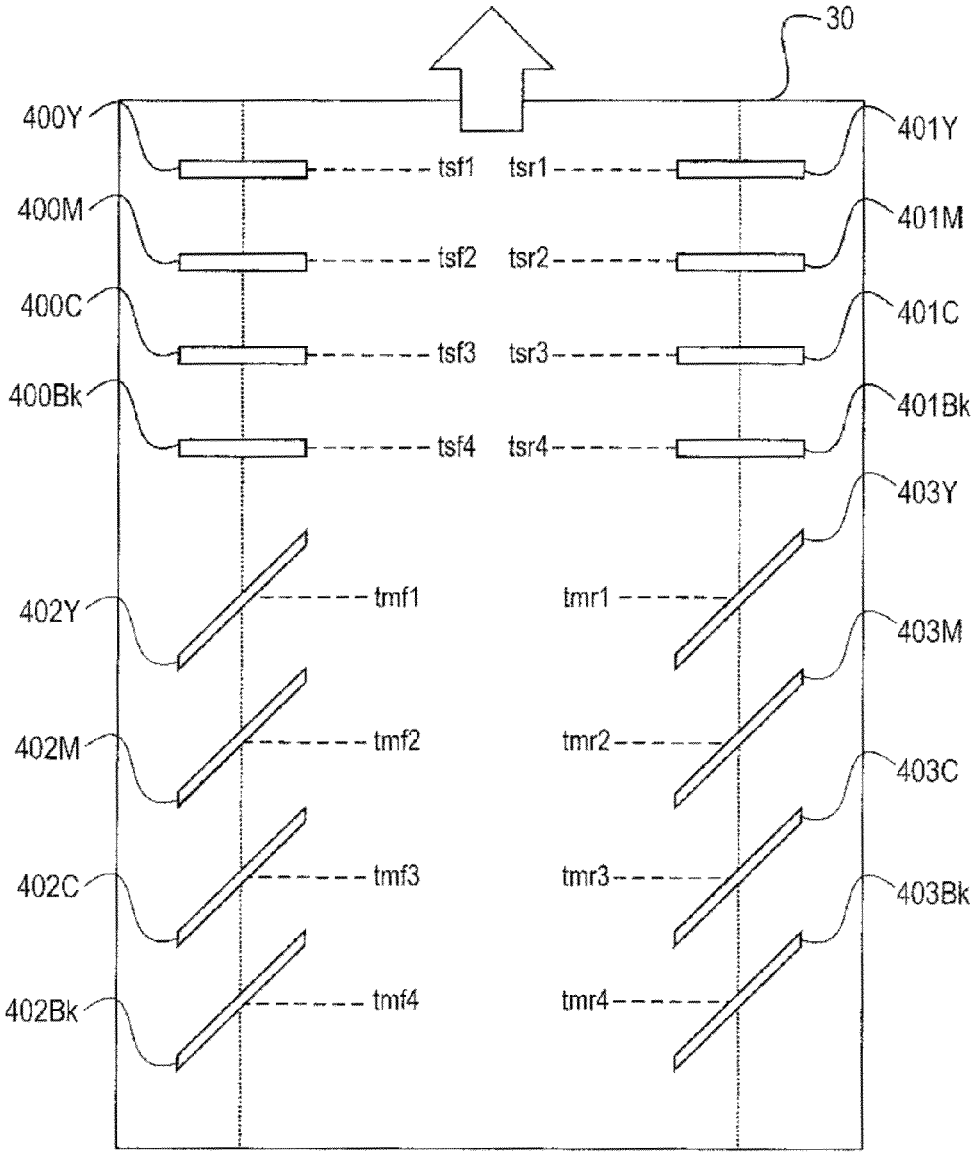
FIG. 12 is a planar explanatory diagram illustrating an example of a misregistration detection pattern formed on an intermediate transfer belt.

The image forming apparatus 10 first forms the misregistration detection patterns (marks) 400, 401, 402 and 403 illustrated in FIG. 12 on the intermediate transfer belt 30 to eliminate the misregistration. Misregistration correction control executed when the temperature in the image forming apparatus 10 is changed after continuous printing or the like is performed by measuring a change in the current by the current detection circuit 50 of the charge high-voltage power circuit 43 described below. The change in the time interval, which is measured by the engine control portion 54, between the departure of the electrostatic latent image patch 80 for detection formed on the photosensitive drum 22 from the exposing position E and the arrival at the detecting position D opposing the charge roller 23 directly reflects the misregistration.

Therefore, during printing, the control is performed to cancel the misregistration. The measuring device measures the time interval between the departure of the electrostatic latent image patch 80 for detection formed on the photosensitive drum 22 from the exposing position E and the arrival at the detecting position D opposing the charge roller 23. The engine control portion 54 calculates a time difference between the detection time interval measured by the measuring device and the preset reference time interval. The engine control portion 54 that also serves as a correcting device for correcting the exposure timing of the laser scanner unit 20 as exposure means corrects the exposure timing according to the time difference. The timing of the emission of the laser beam 21 by the laser scanner unit 20 controlled by the engine control portion 54 is adjusted to correct the misregistration.

<Reference Time Value Obtaining Process>

Figure 11:
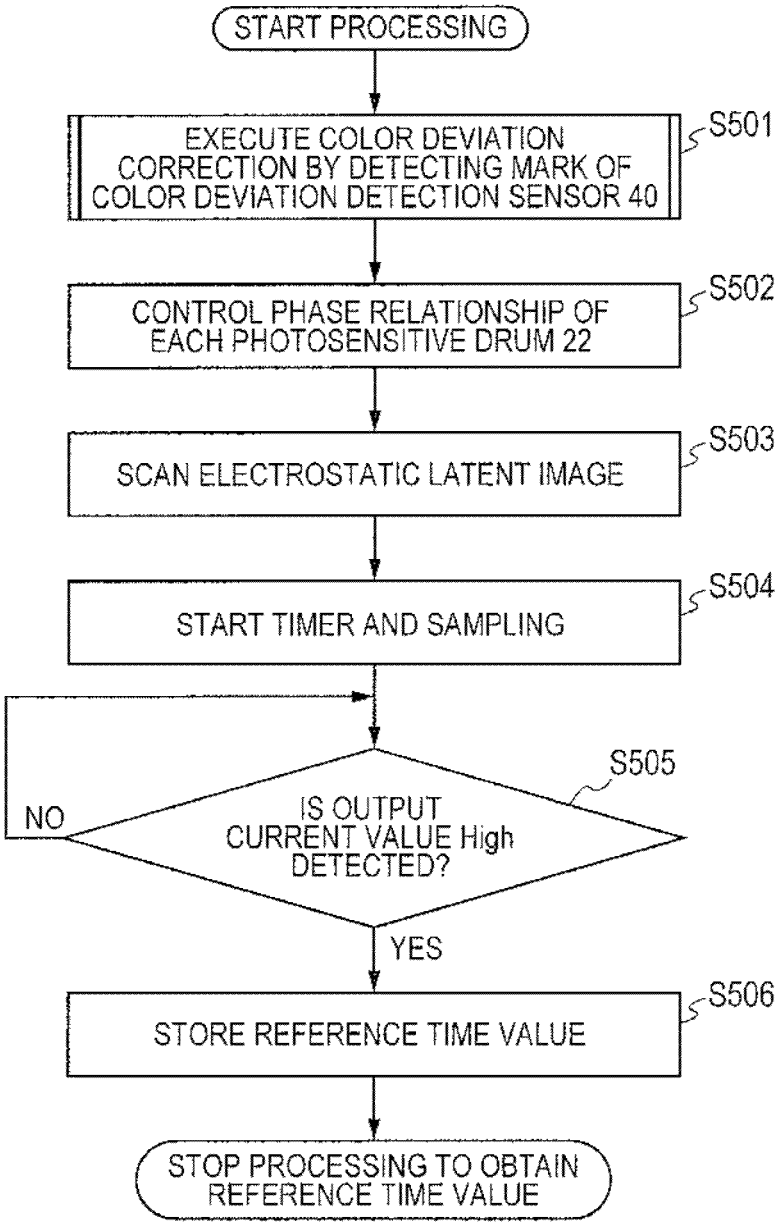
FIG. 11 is a flow chart illustrating a reference time value obtaining process in misregistration correction control of the first embodiment.

A flow chart shown in FIG. 11 illustrates a reference time value obtaining process in the misregistration correction control. In step S501 of FIG. 11, the misregistration detection sensor 40 illustrated in FIG. 1 detects the patterns 400, 401, 402 and 403 for misregistration detection formed on the surface of the intermediate transfer belt 30 illustrated in FIG. 12 to perform normal misregistration correction control. The flow chart illustrated in FIG. 11 may be executed only according to the normal misregistration correction control at specific timing when the normal misregistration correction control of step S501 is executed after replacement of a component such as the photosensitive drum and the developing sleeve 24. The flow chart illustrated in FIG. 11 is independently executed for each color.

The normal misregistration correction control will be described. In step S501 of FIG. 11, the image forming unit in the engine control portion 54 forms the patterns 400, 401, 402 and 403 for misregistration detection on the intermediate transfer belt 30. FIG. 12 illustrates the formation of the patterns 400, 401, 402 and 403 for misregistration detection.

In FIG. 12, the patterns 400 and 401 are for detecting the misregistration in the belt conveyance direction (vertical scanning direction). The patterns 402 and 403 are for detecting the misregistration in the direction (main scanning direction) orthogonal to the belt conveyance direction. The patterns 402 and 403 indicate an example of forming the patterns inclined at an angle of 45 degrees relative to the belt conveyance direction (up and down direction of FIG. 12). In FIG. 12, tsf1 to tsf4, tmf1 to tmf4, tsr1 to tsr4 and tmr1 to tmr4 indicate detection timing of the patterns 400, 401, 402 and 403. An arrow in FIG. 12 denotes a movement direction of the intermediate transfer belt 30.

The moving velocity of the intermediate transfer belt 30 is defined as v (mm/sec), and the yellow Y is the reference color. The logical distances between the patterns of the colors (magenta M, cyan C and black Bk) and yellow Y in the patterns 400 and 401 for detecting the misregistration in the belt conveyance direction are defined as dsY (mm), dsM (mm) and dsC (mm).

Yellow Y is the reference color. As for misregistration δes of each color in the belt conveyance direction (vertical scanning direction), the misregistration between yellow Y and magenta M is defined as δesM, the misregistration between yellow Y and cyan C is defined as δseC, and the misregistration between yellow Y and black Bk is defined as δesBk. The following (1) to (3) of Expression 9 indicate the misregistration of the colors.

Expression 9

$$\delta esM = v\times\{(tsf2-tsf1)+(tsr2-tsr1)\}/2-dsY \quad (1)$$

$$\delta esC = v\times\{(tsf3-tsf1)+(tsr3-tsr1)\}/2-dsM \quad (2)$$

$$\delta esBk = v\times\{(tsf4-tsf1)+(tsr4-tsr1)\}/2-dsC \quad (3)$$

Regarding the direction (main scanning direction) orthogonal to the belt conveyance direction, position deviations δemf and δemr of the left and right colors on the intermediate transfer belt 30 illustrated in FIG. 12 are as follows, expressed by the following (4) to (6) of Expression 10 and (7) to (9) of Expression 11.

Expression 10

$$\delta emfM = v\times(tmf2-tsf2)-v\times(tmf1-tsf1) \quad (4)$$

$$\delta emfC = v\times(tmf3-tsf3)-v\times(tmf1-tsf1) \quad (5)$$

$$\delta emfBk = v\times(tmf4-tsf4)-v\times(tmf1-tsf1) \quad (6)$$

Expression 11

$$\delta emrM = v\times(tmr2-tsr2)-v\times(tmr1-tsr1) \quad (7)$$

$$\delta emrC = v\times(tmr3-tsr3)-v\times(tmr1-tsr1) \quad (8)$$

$$\delta emrBk = v\times(tmr4-tsr4)-v\times(tmr1-tsr1) \quad (9)$$

The misregistration direction can be determined based on positive or negative of the calculation results of Expressions 10 and 11, and the write position is corrected based on δemr indicated by Expression 10. The main scanning width (main scanning magnification) is corrected based on δemr-δemf indicated by Expressions 10 and 11. If there is an error in the main scanning width (main scanning magnification), not only δemr, but also the amount of change in the image frequency changed along with the correction in the main scanning width is taken into account to calculate the write position.

To eliminate the computed misregistration, the engine control portion 54 changes the emission (exposure) timing of the laser beam 21 by the laser scanner unit 20 as an image formation condition. For example, if the misregistration in the belt conveyance direction (vertical scanning direction) is equivalent to −4 lines, the engine control portion 54 instructs the video controller 200 to set the emission timing of the laser beam 21 ahead by +4 lines.

In step S502 of FIG. 11, the engine control portion 54 adjusts the rotation phase relationship between the photosensitive drums 22*a* to 22*d* according to a predetermined state to reduce the influence when there are variations in the rotation velocities of the photosensitive drums 22*a* to 22*d*. Specifically, the phases of the photosensitive drums 22 of the other colors are adjusted relative to the phase of the reference color under the control of the engine control portion 54. In the present embodiment, the photosensitive member gears 704 are arranged on the rotation axes of the photosensitive drums 22, and the home position sensors 705 detect the home position flags 706 arranged on the photosensitive member gears 704 to adjust the phase relationship between the photosensitive member gears 704 of the photosensitive drums 22.

In this way, the rotation velocities of the surfaces of the photosensitive drums 22 when the toner images developed on the photosensitive drums 22 are transferred to the intermediate transfer belt 30 have substantially the same or similar velocity variations.

Specifically, the engine control portion 54 controls the velocity of the motor 700 that drives the photosensitive drum 22 illustrated in FIG. 3B to adjust the rotation phase relationship between the photosensitive drums 22*a* to 22*d* according to the predetermined state. The process of step S502 may be skipped if the rotation velocity variations of the photosensitive drums 22 caused by accuracy errors or error of outer diameters of the photosensitive member gears 704 or the photosensitive drums 22 are so small that the variations can be ignored.

In step S503 of FIG. 11, the engine control portion 54 causes the laser scanner units 20*a* to 20*d* to emit the laser beams 21 in the photosensitive drums 22 at a predetermined rotation phase to form the electrostatic latent image patches 80 for detection on the surfaces of the photosensitive drums 22.

Figure 13:
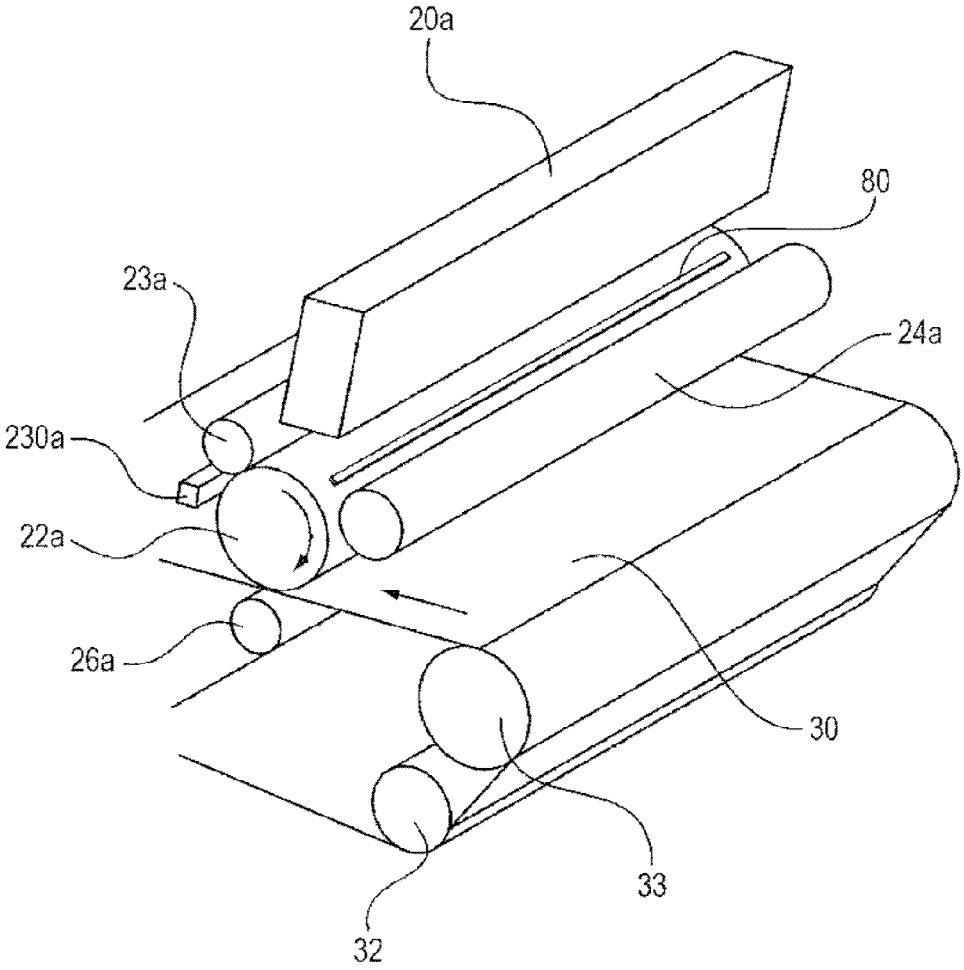
FIG. 13 is a perspective explanatory diagram illustrating a state that an electrostatic latent image for misregistration detection is formed on the photosensitive drum.

FIG. 13 is a diagram illustrating the formation of the electrostatic latent image patch 80 on the surface of the photosensitive drum 22 using the photosensitive drum 22*a* of yellow Y. The maximum width of the depicted electrostatic latent image patch 80 is about 300 mm at the image area width in the main scanning direction, and the electrostatic latent image patch 80 includes one patch with line patterns in the conveyance direction of the intermediate transfer belt 30.

To obtain an excellent detection result, it is desirable to form the electrostatic latent image patch 80 so that the width in the main scanning direction is equal to or greater than the half the maximum width (about 300 mm). In this case, for example, the developing sleeve 24*a* is detached from the photosensitive drum 22*a*, and therefore, the toner does not attach to the electrostatic latent image patch 80. The electrostatic latent image patch 80 formed on the surface of the photosensitive drum 22*a* with the primary transfer roller 26*a* at a detached position is conveyed to the detecting position D where the charge roller 23*a* faces. The attachment of the toner to the electrostatic latent image patch 80 may be prevented by setting the voltage output from the development high-voltage power circuits 44*a* to 44*d* to "0" or by applying a bias with a polarity opposite the normal polarity.

Figure 15A:
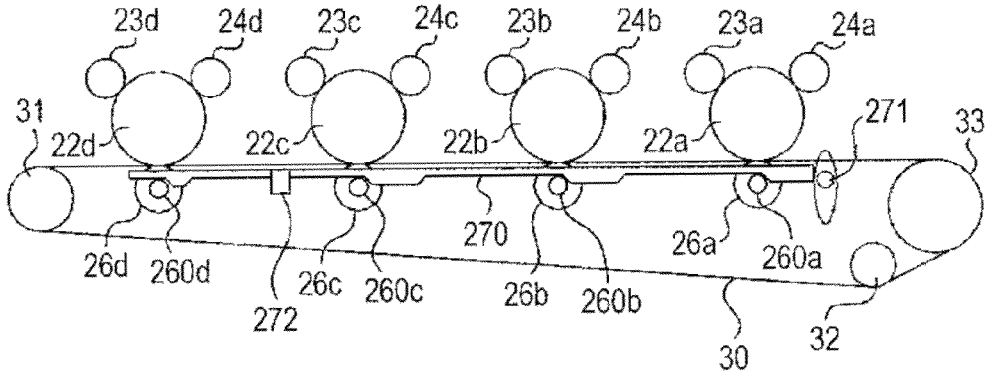
FIGS. 15A, 15B and 15C are diagrams illustrating a contact and separate state that a primary transfer member moves close to and away from an image carrier across the intermediate transfer belt.
Figure 15B:
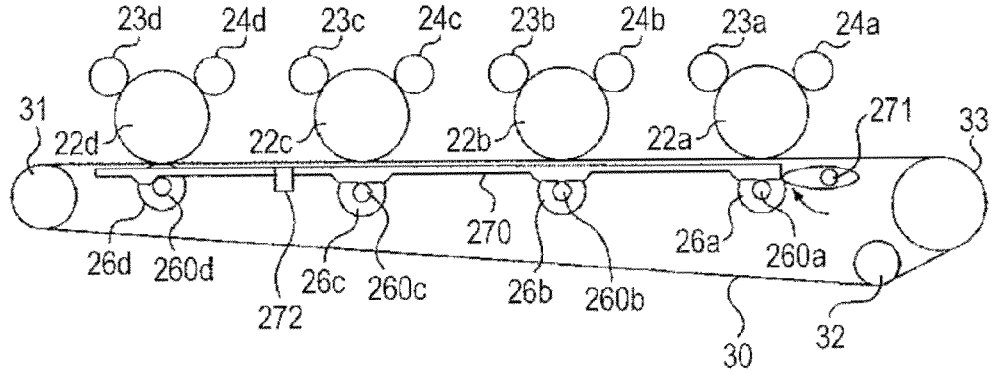
Figure 15C:
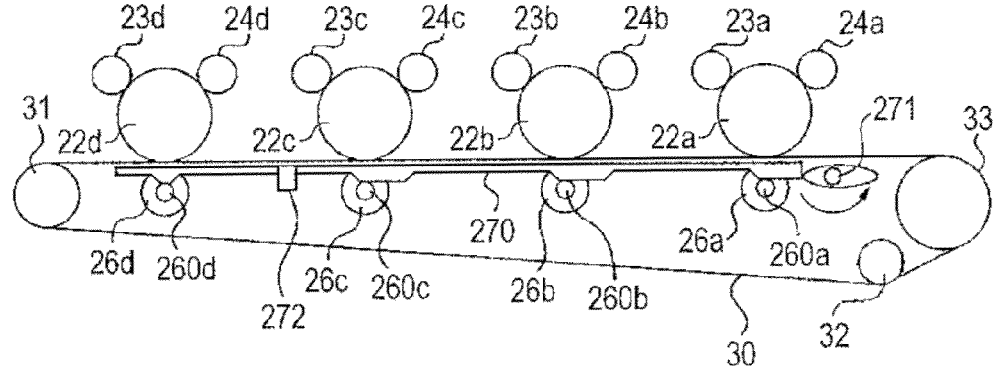

The primary transfer roller 26 is detached by selecting an all primary transfer roller detaching mode illustrated in FIG. 15C among a full color mode, a mono color mode and the all primary transfer roller detaching mode illustrated in FIGS. 15A to 15C.

Positioning members 260*a* to 260*d* that slide and move by abutting to irregular portions arranged on the detachment lever 270 rotatably support the primary transfer rollers 26*a* to 26*d*. Rotation of a detachment cam 271 moves the detachment lever 270 in the left and right direction of FIG. 15. All primary transfer rollers 26*a* to 26*d* are abutted to the photosensitive drums 22*a* to 22*d* through the intermediate transfer belt 30 in the full color mode as illustrated in FIG. 15A.

Only the primary transfer roller 26*d* is abutted to the photosensitive drum 22*d* through the intermediate transfer belt 30, and the other primary transfer rollers 26*a* to 26*c* are detached from the intermediate transfer belt 30 in the mono color mode as illustrated in FIG. 15B. All primary transfer rollers 26*a* to 26*d* are detached from the intermediate transfer belt 30 in the all primary transfer roller detaching mode as illustrated in FIG. 15C.

The detachment lever 270 can be moved to three positions of the full color mode illustrated in FIG. 15A, the mono color mode illustrated in FIG. 15B and the all primary transfer roller detaching mode illustrated in FIG. 15C, for each ¼ rotation of the detachment cam 271 driven by the main body of the image forming apparatus 10.

Figure 16:
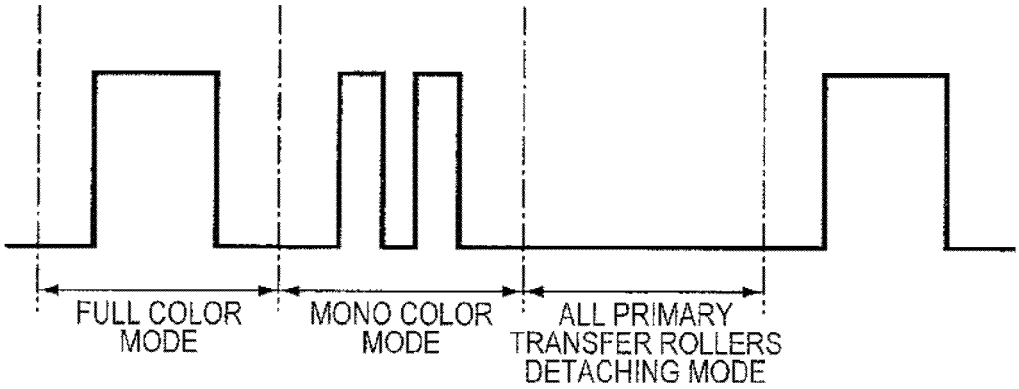
FIG. 16 is a diagram illustrating an example of a detection result of a photo sensor that detects the contact and separate state in which the primary transfer member moves close to and away from the image carrier across the intermediate transfer belt.

The detachment lever 270 includes a mode detection portion in which a photo sensor 272 detects light shielding or light transmission to determine the mode. The photo sensor 272 detects the light shielding or the light transmission as illustrated in FIG. 16 to detect three positions of the full color mode, the mono color mode and the all primary transfer roller detaching mode illustrated in FIGS. 15A to 15C.

During standby, all the primary transfer rollers 26*a* to 26*d* are in the state of the all primary transfer roller detaching mode illustrated in FIG. 15C.

In step S504 of FIG. 11, the engine control portion 54 starts timers prepared according to yellow Y, magenta M, cyan C and black Bk, at the same time or substantially the same time as the process of step S503. More specifically, the measuring device of the engine control portion 54 starts measuring. The current detection circuit 50 connected to the charge roller 23 starts sampling the detection value of the current. In this case, the sampling frequency is, for example, 10 kHz.

In step S504 of FIG. 11, the engine control portion 54 stops measuring by the measuring device of the engine control portion 54 at the time when the detection value is the maximum based on the detection value data of the current detection circuit 50 obtained by sampling in step S503 and calculates the arrival time (step S505). Therefore, the count value from the start to the stop of measuring by the measuring device is equivalent to the time interval between the time of the formation of the electrostatic latent image patch 80 and the time at which the detection value of the current detection circuit 50 is the maximum.

The photosensitive member gears 704 synchronized based on output values 91 of the home position sensors 705 that have detected the home position flags 706 of the photosensitive member gears 704 perform measurement based on the electrostatic latent image patches 80. In this case, the electrostatic latent image patches 80 are depicted at timing that always equalizes the rotation cycles of the photosensitive member gears 704. Therefore, the measurement errors caused by the accuracy of the photosensitive drums 22 and the photosensitive member gears 704 can be ignored in the configuration of the present embodiment.

In step S506 of FIG. 11, the engine control portion 54 stores, in the EEPROM 324, a reference time value (equivalent to reference time interval) which is the time interval (count value) from the time of the formation of the electrostatic latent image patch 80 calculated in steps S504 and S505 to the time at which the detection value of the current detection circuit 50 is the maximum. The EEPROM 324 may be, for example, a RAM with a backup battery.

<Detection of Output Current Value>

Step S505 of FIG. 11 will be described in detail. The reason that an output current value 90 of the current detection circuit 50*a* upon the arrival of the electrostatic latent image patch 80 at the charge roller 23*a* has a rectangular wave 92 as illustrated in FIG. 14 and that it is suitable to measure the time when the rectangular wave turns to a high value will be described. This is because the timing of the arrival of the electrostatic latent image patch 80 at the charge roller 23*a* can be accurately measured even if the absolute value of the output current value 90 of the current detection circuit 50*a* is changed due to environmental variations or durability variations.

At the same time, if the threshold can be changed based on the maximum value and the minimum value, a more accurate midpoint of the maximum and the minimum can be detected. The reason that the electrostatic latent image patch 80 for detection has the shape as illustrated in FIG. 13 is to increase the change in the current value detected by the charge roller 23*a* based on a wide pattern in the main scanning direction. The width is equivalent to several lines in the rotation direction (vertical scanning direction) of the photosensitive drum 22. In this way, the maximum point sharply emerges while the large change in the current value is maintained, and the contrast is increased.

The optimal shape of the electrostatic image patch image 80 varies depending on the configuration of the image forming apparatus 10. The width is equivalent to 30 lines in the rotation direction (vertical scanning direction) of the photosensitive drum 22 used in the present embodiment. The electrostatic image patch image 80 has a single pattern with a width of about 300 mm in the axial direction (main scanning direction) of the photosensitive drum 22. However, the shape is not limited to this.

A flow chart illustrated in FIG. 17 described later is executed. In the execution, a detection result of the output current value 90 of the current detection circuit 50*a* upon the arrival of the electrostatic latent image patch 80 at the charge roller 23*a* is calculated. A position coinciding with the position on the surface of the photosensitive drum 22 where the output current value 90 is detected in the flow chart of FIG. 11 can be detected from the detection result.

Figure 17:
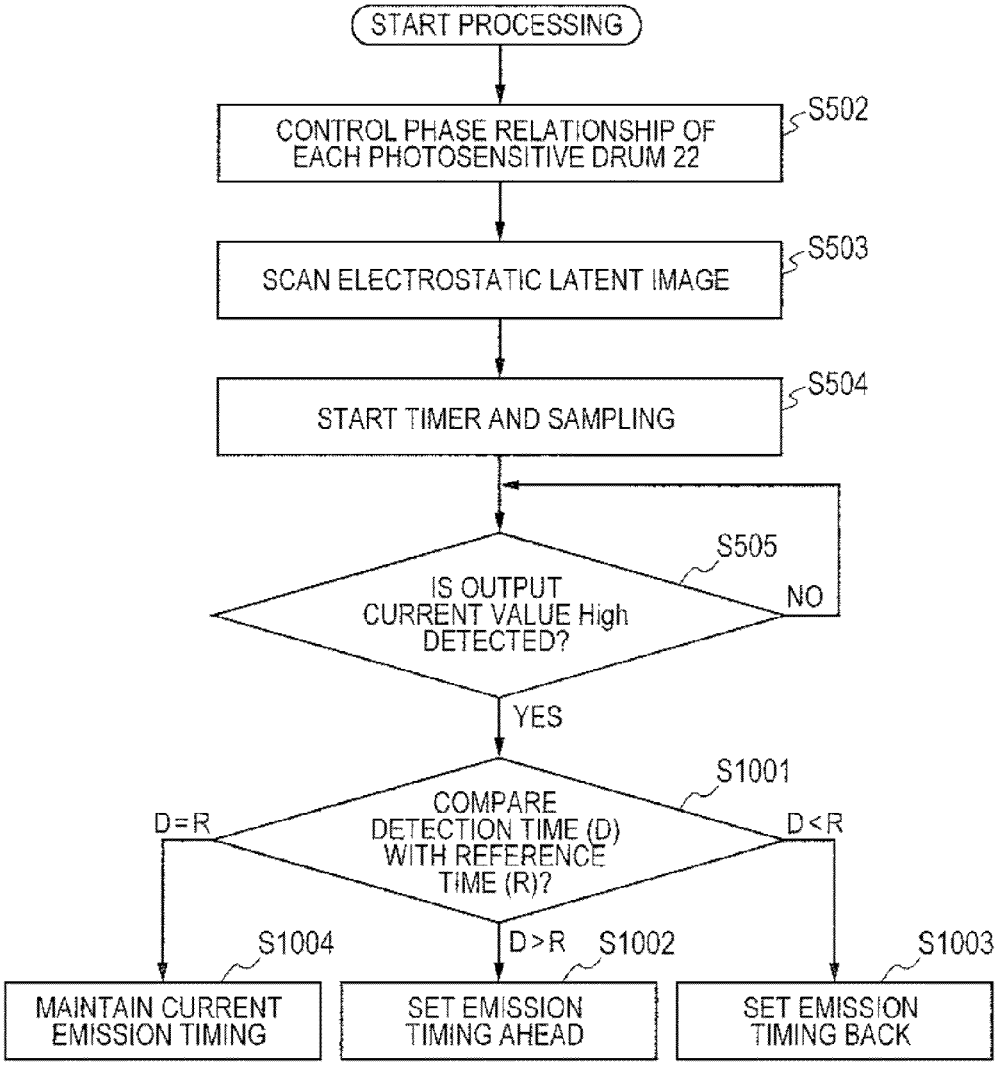
FIG. 17 is a flow chart illustrating another reference time value obtaining process in the misregistration correction control of the first embodiment.

According to the mode, the position on the surface of the photosensitive drum 22 based on various detection results can be applied to the determination of whether the output current value 90 in step S505 of FIGS. 11 and 17 is detected. The same applies to a second embodiment and flow charts of FIGS. 27 and 28 described later.

The state after the execution of S503 to S506 and the acquisition of the reference time value is defined as a reference state. In the present embodiment, the motor gear 701 and the idler stage gear 702 rotate integer numbers of times while the photosensitive drum 22 rotates from the exposing position E to the detecting position D in the reference state.

A misregistration correction control operation using the charge roller 23 described next is executed to perform correction for handling the variation in the emission position of the laser beam by the laser scanner unit 20 based on the reference state.

<Misregistration Correction Control Operation Using Charge Roller>

Misregistration correction control using the charge roller in the present embodiment will be described with reference to the flow chart of FIG. 17. After the execution of the reference time value obtaining process, the Misregistration correction control operation using the charge roller is executed when a plurality of sheets is continuously printed by execution of one job or by continuous execution of a plurality of jobs. The flow chart of FIG. 17 is independently executed for each color.

After the execution of the reference time value obtaining process, the emission position (exposing position E) of the emission of the laser beam 21 by the laser scanner unit 20 is changed by the continuous printing of a plurality of sheets. As a result, the time interval between the departure of the electrostatic latent image patch 80 from the exposing position E and the arrival at the detecting position D opposing the charge roller 23 is also changed. The flow chart of FIG. 17 is executed to detect the change, and as in the flow chart of FIG. 11, the electrostatic latent image patch 80 is formed to measure the time interval until the arrival at the detecting position D. Details of steps S502 to S505 of FIG. 17 are the same as in the process of steps S502 to S505 illustrated in FIG. 11, and the description will not be repeated. A count value that is equivalent to the time interval between the time of the formation of the electrostatic latent image patch 80 and the time at which the detection value of the current detection circuit 50 is the maximum, the count value indicating from the start to the stop of measuring by the measuring device, is defined as a detection time interval.

In step S1001 of FIG. 17, the engine control portion 54 compares the detection time interval with the reference time value. The detection time interval is time (count value) at which the detection value of the current flowing through the charge roller 23 is the maximum in the detection of the electrostatic latent image patch 80 in step S505 of FIG. 17. The reference time value is a reference time value equivalent to the reference time interval stored in step S506 of FIG. 11.

In step S1001 of FIG. 17, the detection time interval (count value) may be greater than the reference time value. In that case, in step S1002, the engine control portion 54 as a correcting device performs correction to set ahead the emission timing of the laser beam 21 by the laser scanner unit 20 during printing.

In step S1001 of FIG. 17, the detection time interval (count value) may be smaller than the reference time value. In that case, in step S1003, the engine control portion 54 as a correcting device performs correction to set back the emission timing of the laser beam 21 by the laser scanner unit 20 during printing. If the detection time interval and the reference time interval are equal, the emission timing of the laser beam 21 by the laser scanner unit 20 is not changed.

Therefore, the image formation condition correction process in steps S1002 and S1003 of FIG. 17 can correct the Misregistration caused by deviation in the rotation axes of the photosensitive drums 22 or caused by error of outer diameters in the photosensitive member gears 704 in terms of gear accuracy.

As illustrated in the present embodiment, the detection error of the electrostatic latent image patch 80 formed on the surface of the photosensitive drum 22 is 21 μm or less. In that case, the angle error in the rotation direction of the photosensitive drum 22 at the detecting position D can be within about 7 degrees in the process of the movement of the photosensitive member gear 704 from the exposing position E to the detecting position D while the idler stage gear 702 rotates an integer number of times.

Figure 14A:
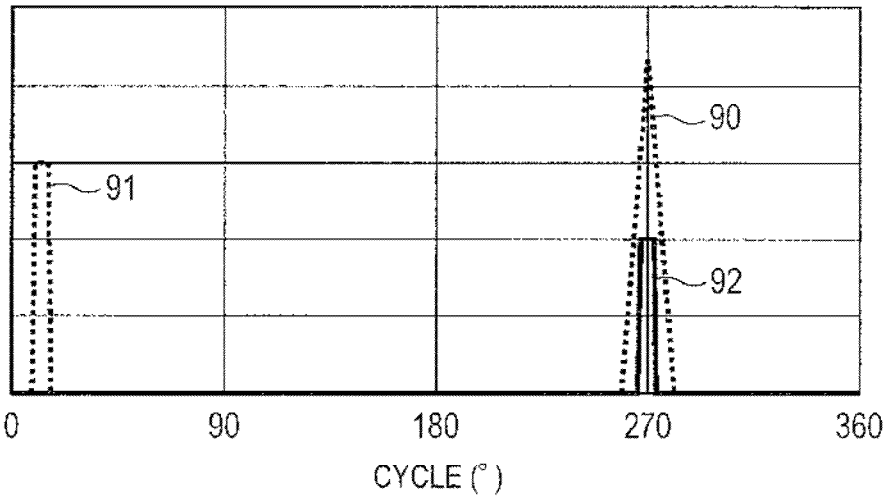
FIG. 14A is a diagram illustrating detection of the electrostatic latent image for misregistration detection formed on the photosensitive drum by charge means that also serves as a detector.
Figure 14B:
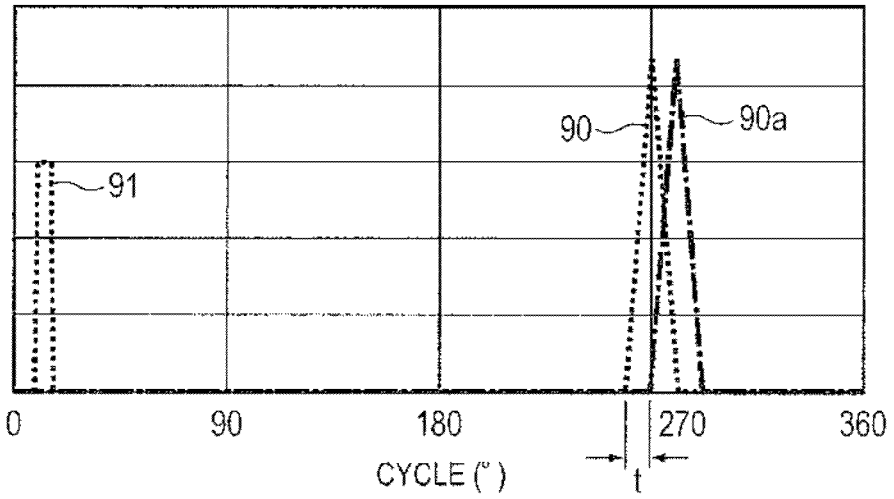
FIG. 14B is a diagram illustrating a state that the electrostatic latent image for misregistration detection formed on the photosensitive drum is detected t time late.

FIGS. 14A and 14B illustrate an example of detection results of the current detection circuit 50*a*. FIG. 14A illustrates the output current value 90 of the current detection circuit 50*a* when the electrostatic latent image patch 80 reaches the charge roller 23*a* in obtaining the reference time value of the flow chart illustrated in FIG. 11. FIG. 14A also illustrates the output value 91 of the home position sensor 705 obtained by detecting the home position flag 706 of the photosensitive member gear 704. The rectangular wave 92 is obtained by detecting, as a rectangular wave, the output current value 90 of the current detection circuit 50*a*. The horizontal axis of FIG. 14A displays, by angle, the surface position in the rotation direction of the photosensitive drum 22*a*.

The photosensitive member gear 704 synchronized based on the output value 91 of the home position sensor 705 obtained by detecting the home position flag 706 of the photosensitive member gear 704 performs measurement based on the electrostatic latent image patch 80. In this case, the electrostatic latent image patch 80 is depicted at timing that the rotation cycle of the photosensitive member gear 704 is always the same. Therefore, the measurement errors caused by the accuracy of the photosensitive drum 22 and the photosensitive member gear 704 can be ignored in the configuration of the present embodiment.

FIG. 14B illustrates the output current value 90*a* of the current detection circuit 50*a* upon the arrival of the electrostatic latent image patch 80 at the charge roller 23*a* in the Misregistration correction control operation using the charge roller illustrated in the flow chart of FIG. 17. The laser scanner unit 20 depicts the electrostatic latent image patch 80 detected at this point, at timing that the rotation cycle of the photosensitive member gear 704 is the same as in the reference time value obtaining process. As illustrated in FIG. 14B, the output current value 90*a* is detected after time t from the detection of the output current value 90 of the current detection circuit 50*a* upon the arrival of the electrostatic latent image patch 80 at the charge roller 23*a*.

In this case, the intervals between the exposure time by the laser scanner unit 20 and the times of the changes in the output current values of the current detection circuit 50*a* due to the arrival of the electrostatic latent image patch 80 at the charge roller 23*a* are the reference time interval and the detection time interval. The difference (time t) between the two time intervals is the variation of the exposing position (emission position) on the surface of the photosensitive drum 22.

Based on the configuration, the laser scanner unit 20 exposes the surface of the photosensitive drum 22 along with the rotation of the photosensitive drum 22 to form the electrostatic latent image patch 80 for detection. The engine control portion 54 that also serves as the measuring device measures the detection time interval between the formation of the electrostatic latent image patch 80 at the exposing position E and the arrival at the detecting position D of the electrostatic latent image patch 80 for detection detected by the charge roller 23 as a detector.

The engine control portion 54 that also serves as the correcting device corrects the exposure timing of the laser scanner unit 20 according to the time difference between the measured detection time interval and the preset reference time interval. In this way, the exposure timing of the laser scanner unit 20 can be corrected according to the variation of the emission position of the laser beam on the photosensitive drum 22 by the laser scanner unit 20.

In the present embodiment, the rotation member that rotates the photosensitive drum 22 rotates an integer number of times while the photosensitive drum 22 rotates from the exposing position E to the detecting position D in the reference state. In other words, the image (latent image) formed by the laser scanner unit 20 on the photosensitive drum 22 at the exposing position reaches the detecting position when the rotation member rotates an integer number of times in the reference state. As a result, the variation in the rotation velocity of the surface of the photosensitive drum 22 caused by the accuracy error or error of outer diameter of the rotation member does not have to be taken into account, and the time from the formation of the patch at the exposing position to the detection at the detecting position can be accurately detected.

Although the charge roller 23 detects the arrival of the electrostatic latent image patch on the photosensitive drum 22 in the present embodiment, the detection method is not limited to this.

More specifically, a potential sensor that detects the potential of the surface of the photosensitive drum 22 may be arranged at the position of the charge roller 23, and the position may serve as the detecting position D. The present embodiment may be applied to the configuration using the potential sensor, and the latent image formed by the laser scanner unit 20 on the photosensitive drum 22 at the exposing position may reach the detecting position when the rotation member rotates an integer number of times in the reference state.

A toner detection sensor that detects the toner on the photosensitive drum 22 may be arranged at the position of the charge roller 23, and the position may serve as the detecting position D. The development apparatus 25 may develop the electrostatic latent image patch 80 to form a toner patch image, and the toner patch image may be detected at the detecting position D. In this case, the charge roller 23 can be arranged on the downstream of the detecting position D and on the upstream of the exposing position E. The present embodiment may be applied to the configuration using the toner sensor, and the latent image formed by the laser scanner unit 20 on the photosensitive drum 22 at the exposing position may be converted to the toner image to reach the detecting position when the rotation member rotates an integer number of times in the reference state. In this case, the charge roller 23 may be arranged on the downstream of the detecting position D and on the upstream of the exposing position E.

Second Embodiment

A second embodiment of the image forming apparatus according to the present invention will be described with reference to FIGS. 19 to 29. In the first embodiment, the motors 700 rotate and drive the photosensitive drums 22 as illustrated in FIG. 3B. In the present embodiment, a single motor 720 rotates and drives the photosensitive drums 22 as illustrated in FIG. 20B. The same components as in the first embodiment are designated with the same reference numerals, and the description will not be repeated.

Figure 19:
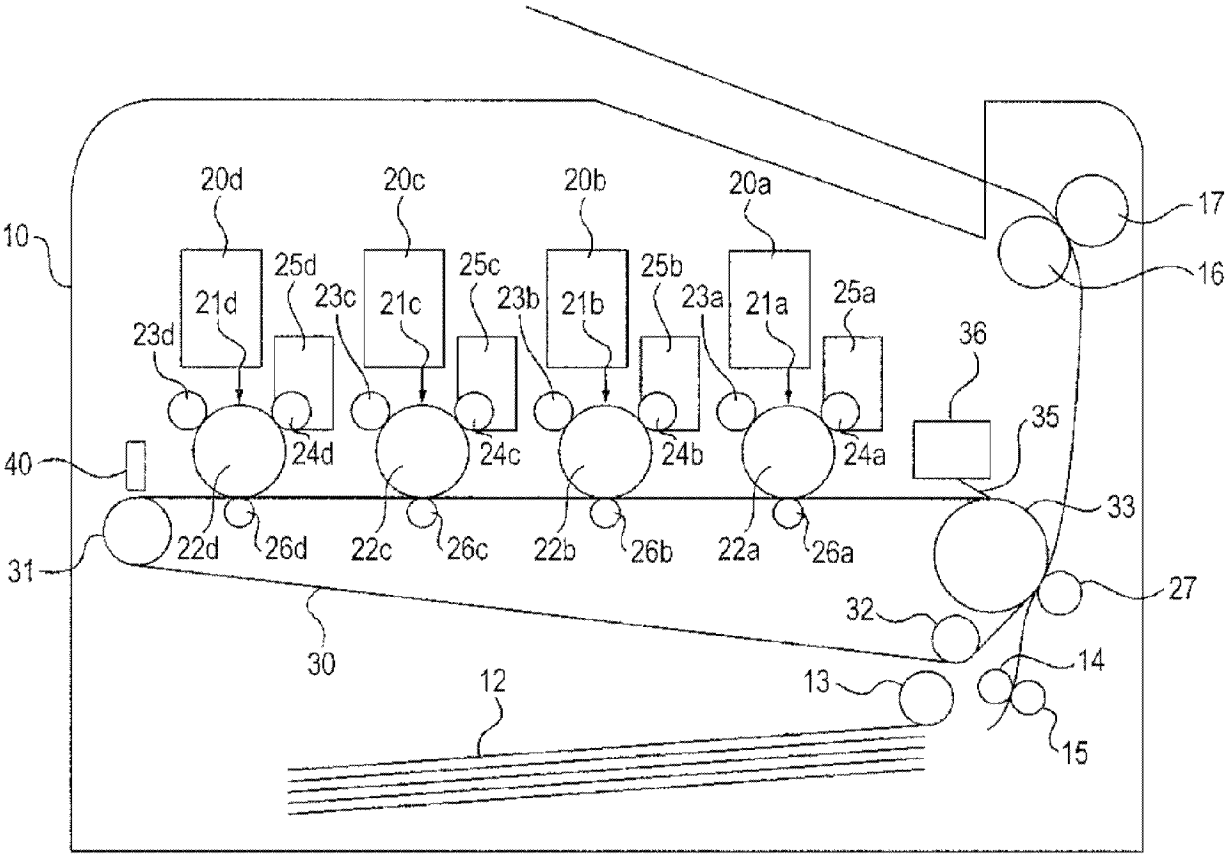
FIG. 19 is a cross-sectional explanatory diagram illustrating a configuration of a second embodiment of the image forming apparatus according to the present invention.
Figure 20A:
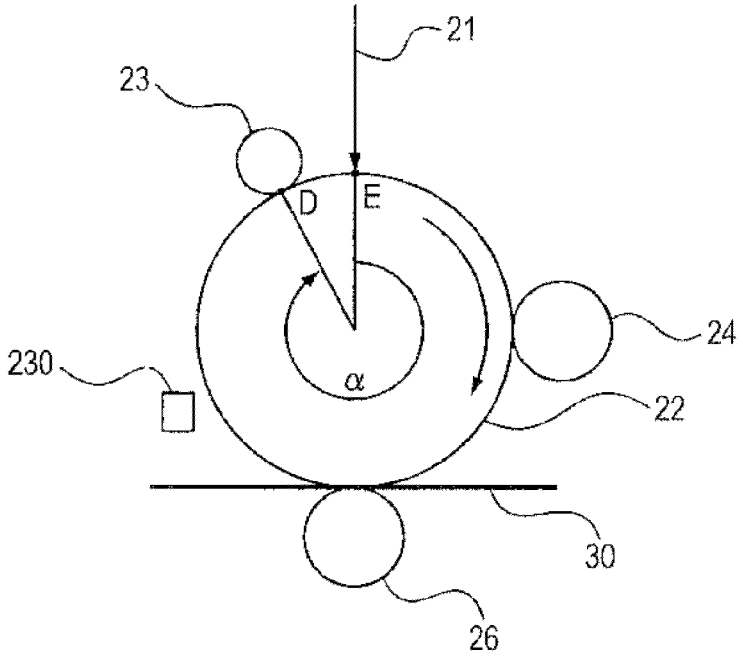
FIG. 20A is a diagram illustrating the exposing position by the exposure means and the detecting position of the electrostatic latent image for detection according to the second embodiment.
Figure 20B:
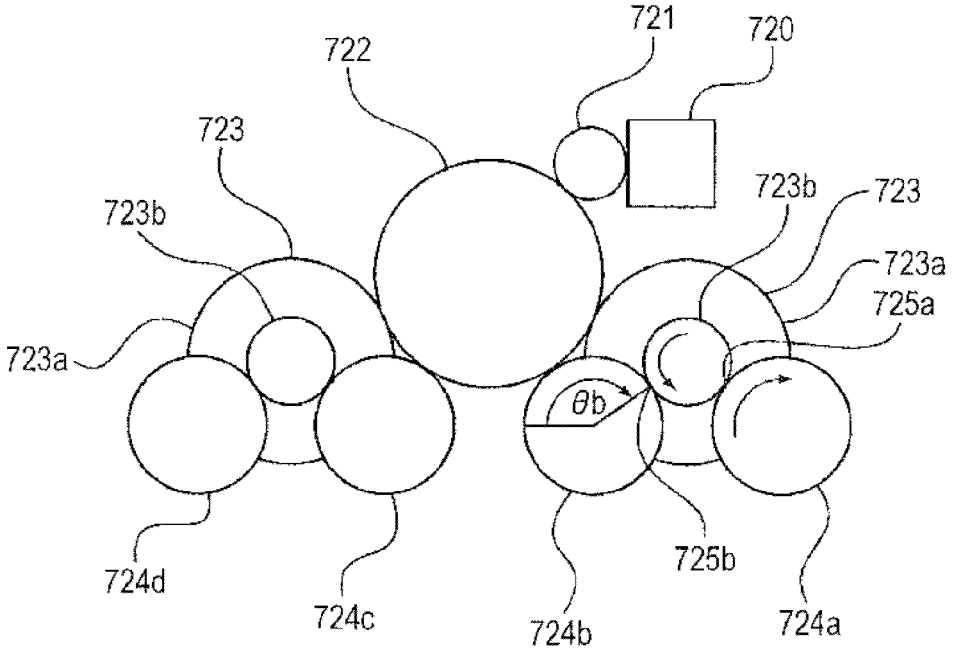
FIG. 20B is a drive configuration diagram from the motor to the photosensitive member gear arranged on the photosensitive drum.

FIG. 19 is a cross-sectional explanatory diagram illustrating the image forming apparatus 10 of the present embodiment. FIG. 20A is a diagram illustrating the exposing position E by the laser scanner unit 20 as exposure means and the detecting position D of the electrostatic latent image patch 80 for detection according to the present embodiment.

In FIG. 20A, the developing sleeve 24, the intermediate transfer belt 30, the primary transfer roller 26, the pre-exposure device 230 and the charge roller 23 as a detector as well as charge means are arranged around the photosensitive drum 22 as an image carrier.

Figure 2:
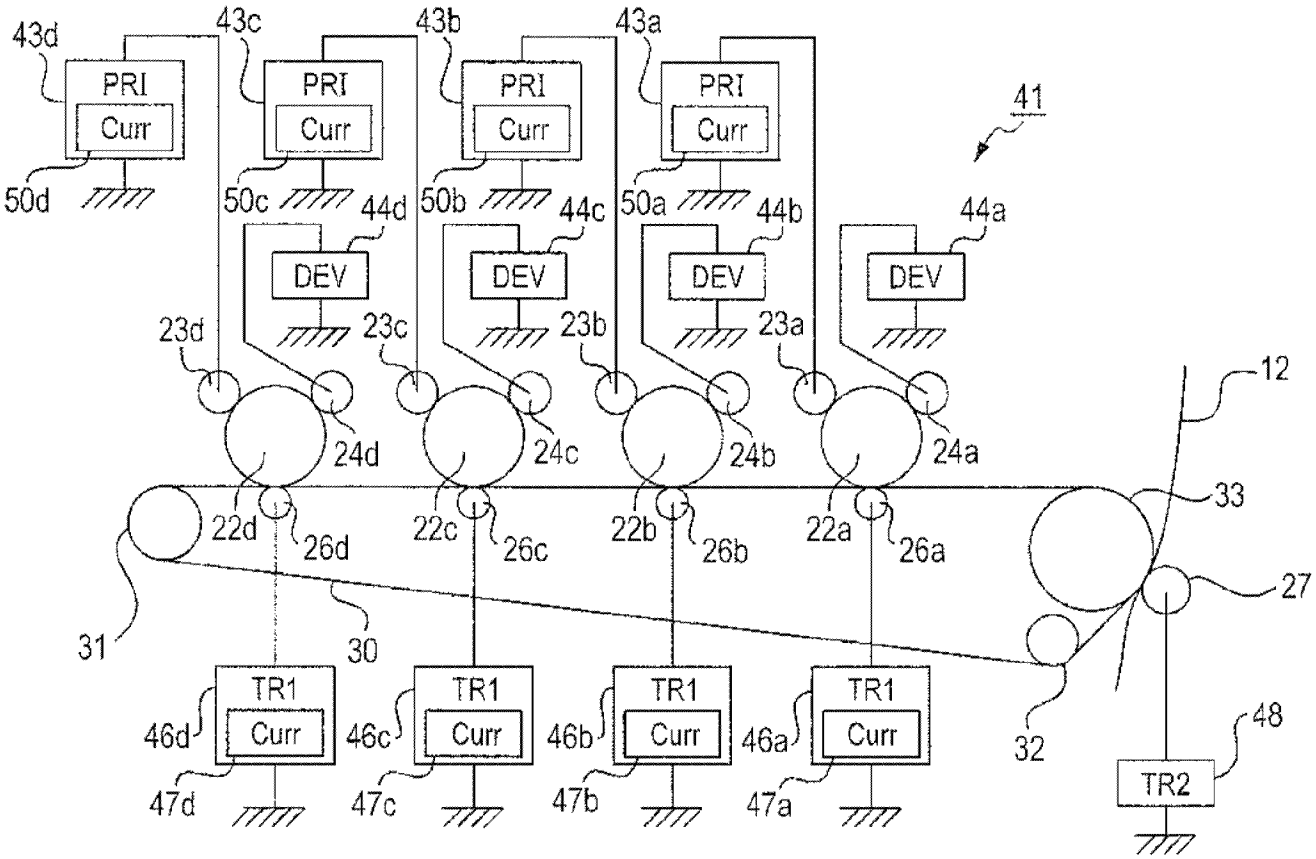
FIG. 2 is a block diagram illustrating a configuration of a high-voltage power apparatus arranged on the image forming apparatus.

The charge roller 23 includes the current detection circuit 50 in the charge high-voltage power circuit 43 illustrated in FIG. 2, and the current detection circuit 50 detects, as a current, a potential difference generated by the electrostatic latent image patch 80 for detection depicted on the surface of the photosensitive drum 22.

In this case, the rotation angle $\alpha$ of the photosensitive drum 22 in the rotation direction from the exposing position E to the detecting position D opposing the charge roller 23 as a detector is 340.4 degrees. The exposing position E is a position on the surface of the photosensitive drum 22 emitted by the laser beam 21 from the laser scanner unit 20 as exposure means.

FIG. 20B illustrates a gear configuration of a drive system that rotates and drives the photosensitive drums 22 of the present embodiment.

In FIG. 20B, a motor gear 721 is fixed to the drive shaft of the motor 720 as a drive source. An idler gear 722 is meshed with the motor gear 721. Large diameter gears 723*a* of two idler stage gears 723 are meshed with the idler gear 722. Two of the four photosensitive member gears 724*a*, 724*b*, 724*c* and 724*d* are meshed with each of the small diameter gears 723*b* of the two idler stage gears 723.

In this way, the rotation driving force of the motor 720 is transmitted to the photosensitive member gears 724*a*, 724*b*, 724*c* and 724*d* through the motor gear 721, the idler gear 722 and the two idler stage gears 723. The photosensitive drums 22*a*, 22*b*, 22*c* and 22*d* are arranged on the same axes as the photosensitive member gears 724*a*, 724*b*, 724*c* and 724*d*, respectively, and the rotation driving force is transmitted through joint couplings not illustrated.

In the present embodiment, the photosensitive drum 22 represents the four photosensitive drums 22*a*, 22*b*, 22*c* and 22*d* of yellow Y, magenta M, cyan C and black Bk to prevent the complication of the description. The photosensitive member gear 724 represents the photosensitive member gears 724*a*, 724*b*, 724*c* and 724*d* in the description. The same applies to related image formation process means.

The photosensitive member gears 724*a* to 724*d* of the present embodiment are arranged with predetermined phases relative to the idler stage gears 723.

As for the predetermined phase, a first color station is driven by the photosensitive member gear 724*a*. The exposure is started while the photosensitive member gear 724*a* is meshed with the small diameter gear 723*b* of the idler stage gear 723 at a mesh position 725*a* where the photosensitive member gear 724*a* is meshed with the small diameter gear 723*b* of the idler stage gear 723.

Consequently, the photosensitive member gear 724*b* drives a color station of the color to be transferred. In this case, the photosensitive member gear 724*b* is arranged in a direction in which the phase is delayed by an angle θb to start the exposure in the same phase at a mesh position 725*b* where the photosensitive member gear 724*b* is meshed with the small diameter gear 723*b* of the idler stage gear 723. The photosensitive member gears 724*c* and 725*d* are similarly arranged by shifting the phases.

According to the phase arrangement of the photosensitive member gears 724*a* to 724*d*, the image can be depicted in the same phase between different stations. The home position flag 706 as a phase detection flag does not have to be arranged on the photosensitive member gear 724 as in the first embodiment illustrated in FIG. 3B.

If the rotation axis of the photosensitive drum 22*a* has a deviation that cannot be ignored, the measurement result of the time from the departure from the exposing position E where the laser beam 21 is emitted by the laser scanner unit 20 to the arrival of the electrostatic latent image patch 80 at the detecting position D opposing the charge roller 23 is changed.

Therefore, the electrostatic latent image patches 80 are formed twice within one cycle on the surface of the photosensitive drum 22 in the present embodiment. The second electrostatic latent image patch 80 is formed at a position where the phase on the surface of the photosensitive drum 22 is shifted by 180 degrees in the rotation direction of the photosensitive drum 22 relative to the first electrostatic latent image patch 80 on the surface of the photosensitive drum 22.

The charge roller 23 as a detector detects the arrival of the two electrostatic latent image patches 80 at the detecting position D. The engine control portion 54 as a measuring device that measures the detection time intervals between the departure from the exposing position E where the laser beam 21 is emitted by the laser scanner unit 20 and the arrival of the electrostatic latent image patches 80 at the detecting position D opposing the charge roller 23 measures the detection time intervals. An average value of the detection time intervals is used as a detection time interval to carry out the misregistration correction as in the first embodiment.

Based on the drive configuration, the laser scanner unit 20 exposes and forms the electrostatic latent image patch 80 as a first pattern illustrated in FIG. 13 on the surface of the photosensitive drum 22 as in the first embodiment.

Although not illustrated, the laser scanner unit 20 further exposes and forms the electrostatic latent image patch 80 as a second pattern at a position with the phase shifted by 180 degrees in the rotation direction of the photosensitive drum 22 relative to the first pattern, on the surface of the photosensitive drum 22.

In the present embodiment, the laser scanner unit 20 exposes and forms the electrostatic latent image patches 80 in a horizontal band shape of 30 dots (about 1.2 mm)×300 mm, on the surface of the photosensitive drum 22.

The charge roller 23 detects, as a current, a potential difference generated by the electrostatic latent image patches 80 of the first and second patterns.

In this case, the engine control portion 54 as a measuring device measures the detection time interval between the departure of the electrostatic latent image patch 80, which is formed at the exposing position E illustrated in FIG. 20A, from the exposing position E and the arrival at the detecting position D opposing the charge roller 23, based on the rotation of the photosensitive drum 22.

As in the first embodiment, the velocity of the surface of the rotating photosensitive drum 22 is not always constant in the detection of the electrostatic latent image patch 80 by the charge roller 23, and the velocity variations occur.

A major factor of the velocity variations is that the apparent gear radius varies depending on the rotation angle due to gear accuracy errors or error of outer diameters of the motor gear 721, the idler gear 722, the idler stage gear 723 and the photosensitive member gear 724.

A drive configuration of the drive transmission gears from the motor 720 to the photosensitive drum 22 according to the present embodiment will be described.

As illustrated in FIG. 29, the idler stage gear 723 and the idler gear 722 rotate 4.2 times while the photosensitive member gear 724 fixed to the photosensitive drum 22 rotates once. The motor gear 721 rotates 38.1 times.

The gears rotate, while the photosensitive member gear 724 fixed to the photosensitive drum 22 moves from the exposing position E illustrated in FIG. 20A to the detecting position D opposing the charge roller 23, in the rotation direction of the photosensitive drum 22. As for the numbers of rotations of the gears, the photosensitive member gear 724 rotates 0.95 times, the idler stage gear 723 and the idler gear 722 rotate 4 times, and the motor gear 721 rotates 36 times.

Figure 21A:
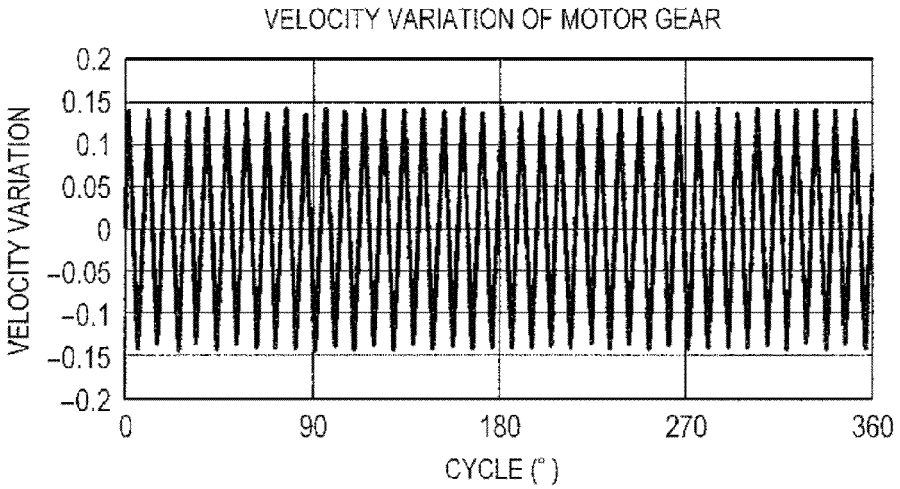
FIG. 21A is a diagram illustrating a velocity variation of the motor gear in one rotation of the photosensitive drum according to the second embodiment.

In the present embodiment, it is assumed that the position variation on the surface of the photosensitive drum 22 due to the backlash (looseness between tooth surfaces) is about 16 μm when the gears are created by the equivalent of grade 2 of JGMA (Japan Gear Manufacturers Association). Assuming that the velocity variation (amplitude) in this case is 1, the velocity variation (amplitude) in the motor gear 721 caused by one rotation of the photosensitive drum 22 is 0.14 in 36 cycles as illustrated in FIG. 21A.

Figure 21B:
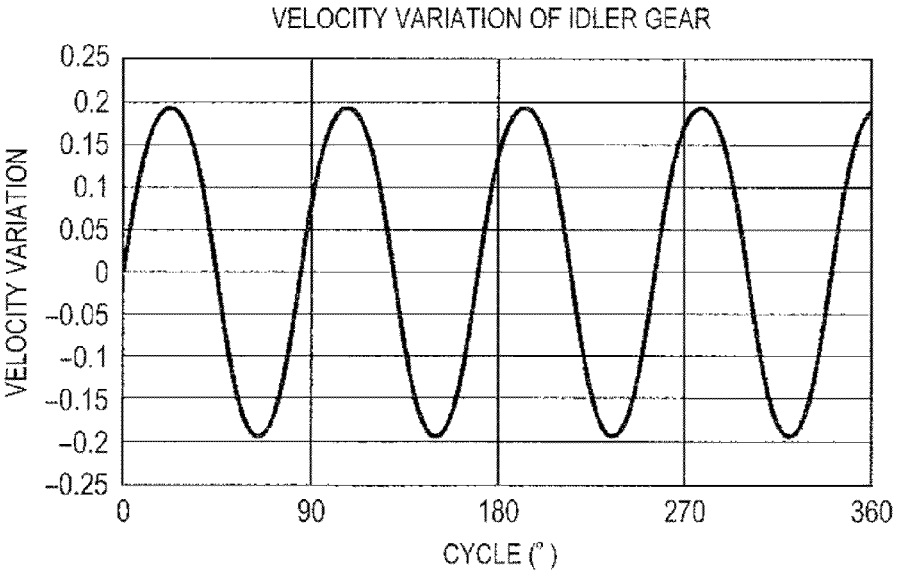
FIG. 21B is a diagram illustrating a velocity variation of the idler gear in one rotation of the photosensitive drum.
Figure 22A:
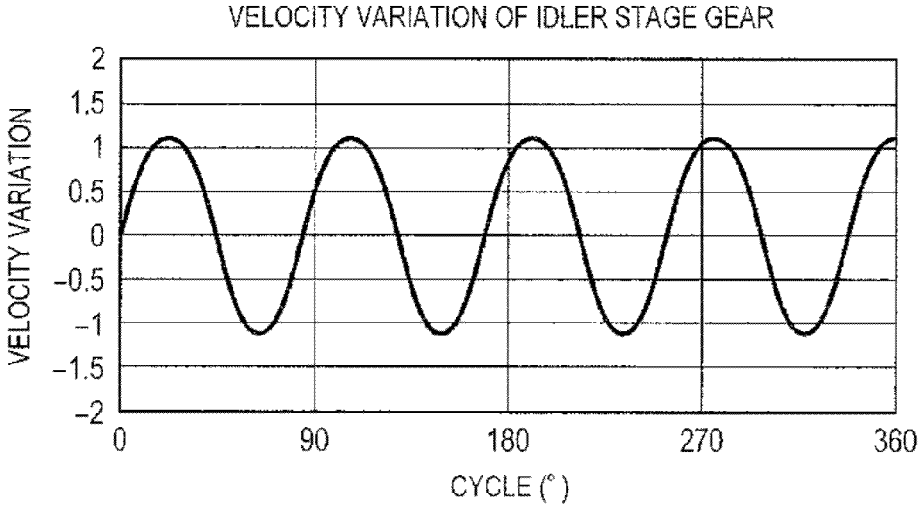
FIG. 22A is a diagram illustrating a velocity variation of the idler stage gear in one rotation of the photosensitive drum according to the second embodiment.

The velocity variation (amplitude) in the idler gear 722 caused by one rotation of the photosensitive drum 22 is 0.19 in four cycles as illustrated in FIG. 21B. The velocity variation (amplitude) in the idler stage gear 723 caused by one rotation of the photosensitive drum 22 is 1.1 in four cycles as illustrated in FIG. 22A.

Figure 22B:
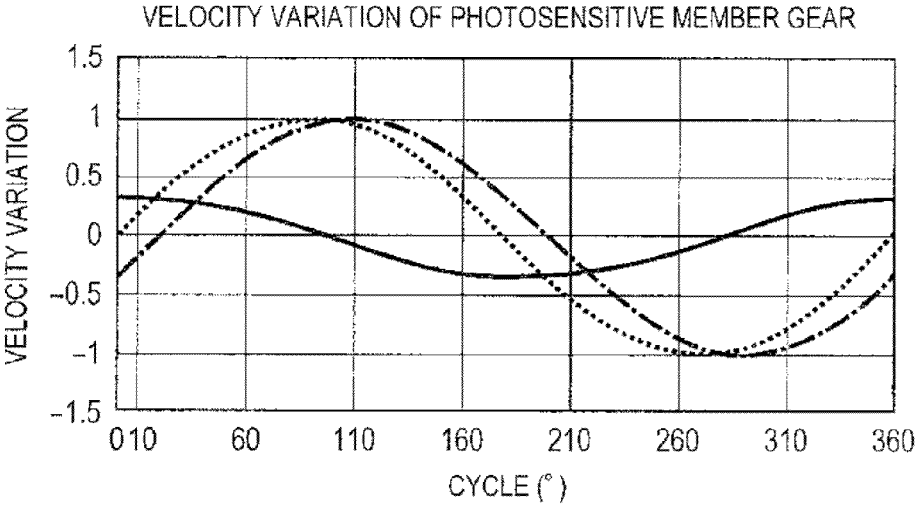
FIG. 22B is a graph illustrating the position on the surface of the photosensitive drum on the horizontal axis and illustrating the velocity variation on the vertical axis.

The velocity variation (amplitude) in the photosensitive member gear 724 caused by one rotation of the photosensitive drum 22 is 1.0 in one cycle as illustrated by a dashed line in FIG. 22B.

As illustrated in FIG. 20A, in the detection of the electrostatic latent image patch 80 for detection depicted on the surface of the photosensitive drum 22 at the detecting position D opposing the charge roller 23, the electrostatic latent image patch 80 is detected at a position 340.4 degrees in the rotation direction of the photosensitive drum, wherein the exposing position E is 0 degree.

FIG. 22B is a graph depicting the position on the surface of the photosensitive drum 22 on the horizontal axis and depicting the velocity variation on the vertical axis. The velocity variation when each point (each polar coordinate point) on the surface of the photosensitive drum 22 passes through the exposing position E is illustrated by a chain line. The velocity variation when each point on the surface of the photosensitive drum 22 passes through the detecting position D is illustrated by an alternate long and short dash line. In this way, the reason that the phases of the chain line and the alternate long and short dash line are deviated by 340.4° is that each point on the surface of the photosensitive drum 22 rotates 340.4° after passing through the exposing position E to pass through the detecting position D.

In this case, the velocity variation of the electrostatic latent image patch 80 for detection on the surface of the photosensitive drum 22 caused by the backlash (looseness between tooth surfaces) is illustrated by a solid line (FIG. 22B) indicating a difference between the velocity variation at the exposing position E and the velocity variation at the detecting position D.

The difference between the velocity variation at the exposing position E and the velocity variation at the detecting position D on each point of the surface of the photosensitive drum 22 is a difference between a chain line and an alternate long and short dash line and is illustrated by a slid line of FIG. 22B.

Figure 23A:
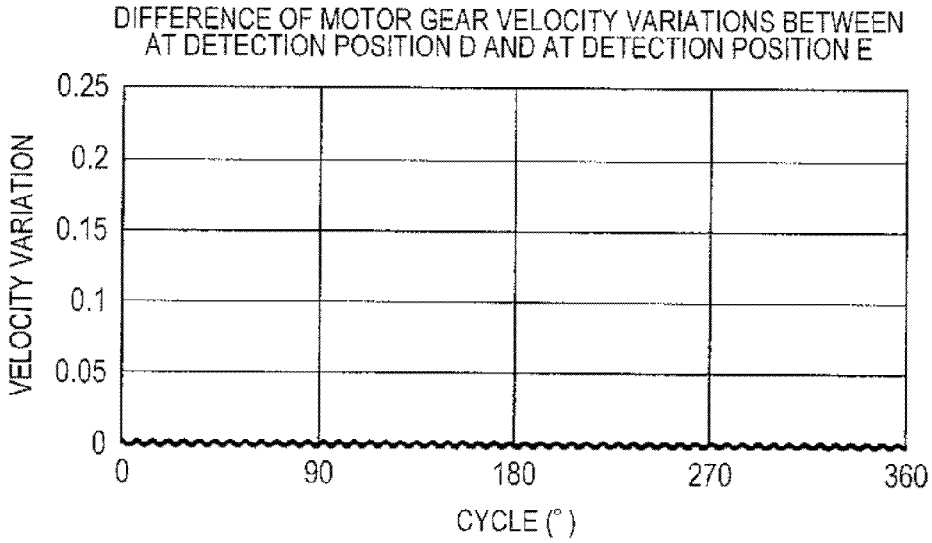
FIG. 23A is a diagram illustrating that the velocity variation of the motor gear is 0 according to the second embodiment.

As for the velocity variation of the motor gear 721, there is a deviation of ¾ cycle between the cycle generated when the electrostatic latent image patch 80 is at the exposing position E and the cycle generated when the electrostatic latent image patch 80 is at the detecting position D. The phase is the same between the component of the first rotation of the motor 720 at the exposing position E and the component of 36/38.1th rotation at the detecting position D where the electrostatic latent image patch 80 reaches the charge roller 23. As illustrated in FIG. 23A, the difference between the velocity variation generated at the exposing position E and the velocity variation generated at the detecting position D is 0.

More specifically, the motor gear 721 included in the drive transmission gear that rotates and drives the photosensitive drum 22 rotates an integer number of times while the photosensitive drum 22 rotates from the exposing position E to the detecting position D. As a result, the variation in the rotation velocity of the surface of the photosensitive drum 22 caused by the accuracy error or error of outer diameter of the motor gear 721 does not have to be taken into account.

Figure 23B:
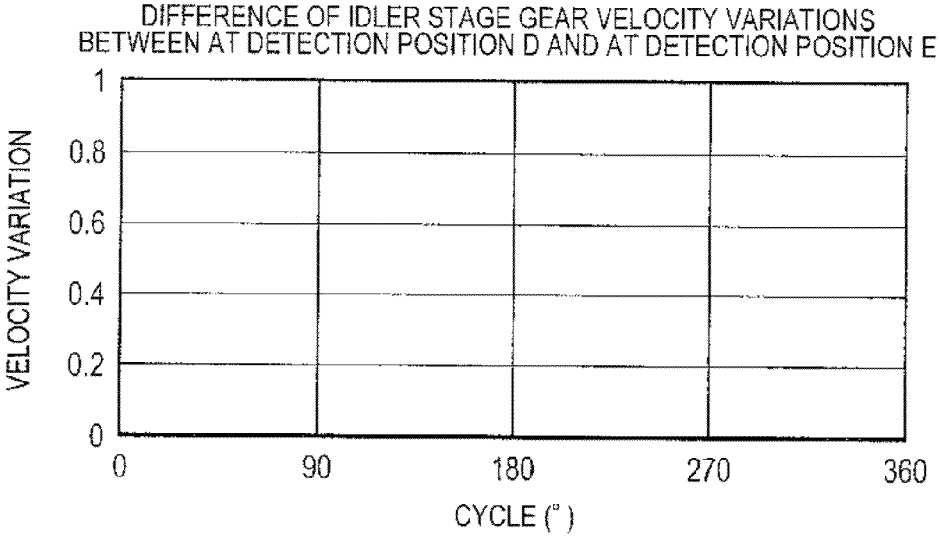
FIG. 23B is a diagram illustrating that the velocity variation of the idler gear is 0 according to the second embodiment.

Similarly, in the idler gear 722, the difference in 4/38.1 cycle between the cycle generated at the exposing position E and the cycle generated at the detecting position D is the component of the first rotation of the motor 720 at the exposing position E. The difference is the component of the fourth rotation of the motor 720 at the detecting position D where the electrostatic latent image patch 80 reaches the charge roller 23. The difference is in the same phase. As illustrated in FIG. 23B, the difference between the cycle generated at the exposing position E and the cycle generated at the detecting position D is 0.

More specifically, the idler gear 722 included in the drive transmission gear that rotates and drives the photosensitive drum 22 rotates an integer number of times while the photosensitive drum 22 rotates from the exposing position E to the detecting position D. As a result, the variation in the rotation velocity of the surface of the photosensitive drum 22 caused by the accuracy error or error of outer diameter of the idler gear 722 does not have to be taken into account.

Figure 24A:
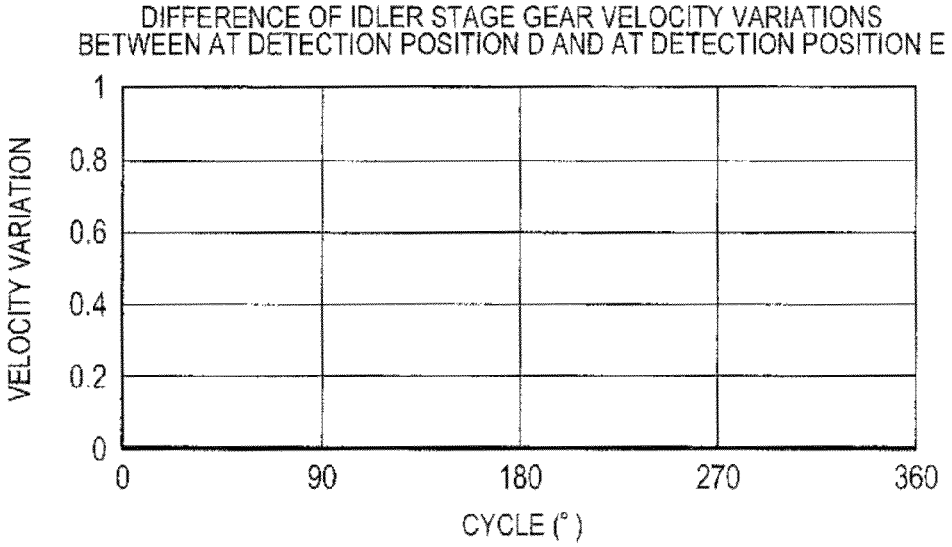
FIG. 24A is a diagram illustrating that the velocity variation of the idler stage gear is 0 according to the second embodiment.

Similarly, in the idler stage gear 723, the difference in 4/38.1 cycle between the cycle generated at the exposing position E and the cycle generated at the detecting position D is the component of the first rotation of the motor 720 at the exposing position E. This is a difference of the fourth cycle of the motor 720 at the detecting position D where the electrostatic latent image patch 80 reaches the charge roller 23. The difference is in the same phase. As illustrated in FIG. 24A, the difference between the cycle generated at the exposing position E and the cycle generated at the detecting position D is 0.

More specifically, a timer not illustrated arranged on the engine control portion 54 that also serves as a measuring device measures the detection time interval. The idler stage gear 723 included in the drive transmission gear that rotates and drives the photosensitive drum 22 rotates an integer number of times while the photosensitive drum 22 rotates from the exposing position E to the detecting position D. As a result, the variation in the rotation velocity of the surface of the photosensitive drum 22 caused by the accuracy error or error of outer diameter of the idler stage gear 723 does not have to be taken into account.

Figure 24B:
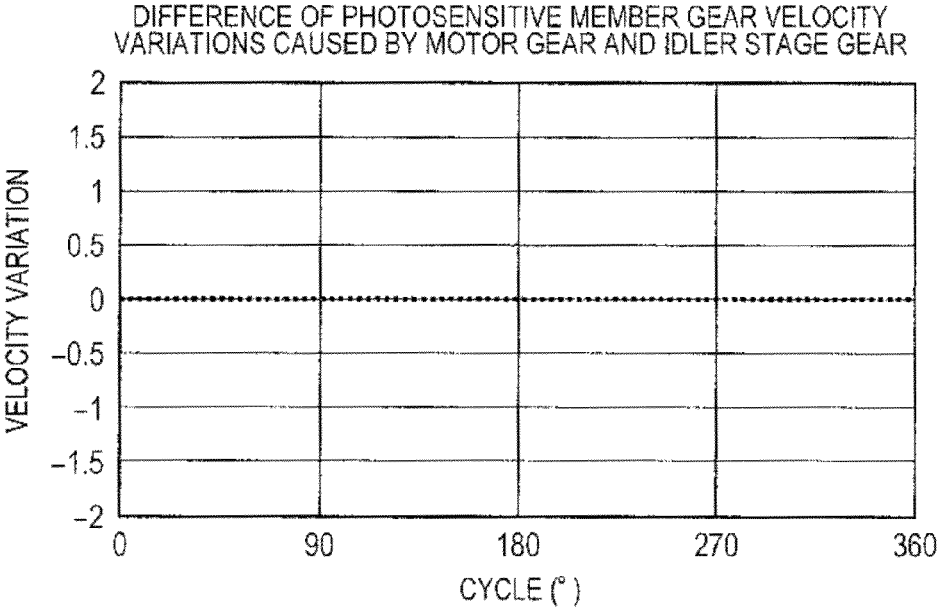
FIG. 24B is a diagram illustrating that a velocity variation of a sum of the velocity variations of the motor gear, the idler gear and the idler stage gear is 0 according to the second embodiment.

As for the detection component on the photosensitive member gear 724 according to the configuration, the sum of the velocity variations (amplitudes) caused by the motor gear 721, the idler gear 722 and the idler stage gear 723 is essentially 0 as illustrated in FIG. 24B. The velocity variations (amplitudes) caused by the single photosensitive member gear 724 are taken into account in the detection of the electrostatic latent image patch 80 for detection.

As described, in the present embodiment, the first and second electrostatic latent image patches 80 for detection are formed at positions shifting the phase by 180 degrees in the rotation direction of the photosensitive drum 22 on the surface of the photosensitive drum 22. As a result, the velocity variations (amplitudes) caused by the single photosensitive member gear 724 and one rotation cycle by the photosensitive drum 22 can be averaged.

A detection error when the detecting position D where the charge roller 23 is arranged is deviated more than the position of 340.4 degrees in the rotation direction of the photosensitive drum 22 relative to the exposing position E will be described.

As an example, velocity variations of the gears and the detection errors caused by the velocity variations when the detecting position D where the charge roller 23 is arranged is at a position of 352.4 degrees, which is 12 degrees more deviated than the position of 340.4 degrees, in the rotation direction of the photosensitive drum 22 relative to the exposing position E will be described.

Figure 25A:
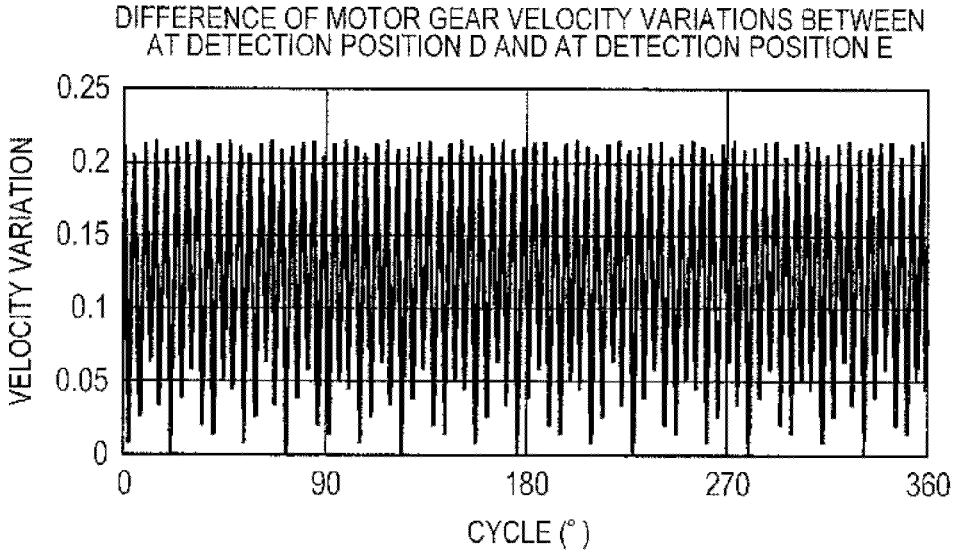
FIG. 25A is a diagram illustrating a velocity variation of the motor gear in one rotation of the photosensitive drum when the exposing position by the exposure means and the detecting position of the electrostatic latent image for detection are at positions of 352.4 degrees according to the second embodiment.

FIG. 25A illustrates a velocity variation of the motor gear 721 caused by one rotation of the photosensitive drum 22. In the present embodiment, from the exposing position E by the laser scanner unit 20 to the detecting position D of the electrostatic latent image patch 80 for detection it is at the position of 352.4 degrees in the rotation direction of the photosensitive drum 22. The phase deviation is 12 degrees greater than the 340.4 degrees illustrated in FIG. 20A.

In the graph illustrated in FIG. 25A, the velocity variation (amplitude) of the motor gear 721 is ΔVm, and the rotation angle of the photosensitive member gear 724 is θ. As illustrated in FIG. 21A, the velocity variation (amplitude) in the motor gear 721 caused by one rotation of the photosensitive drum 22 is 0.14. In this case, the velocity variation (amplitude) ΔVm of the motor gear 721 is expressed by the following Expression 12.

$$\Delta Vm=|0.14\times\{\sin(\theta)-\sin(352.4°)\}| \quad \text{Expression 12}$$

Figure 25B:
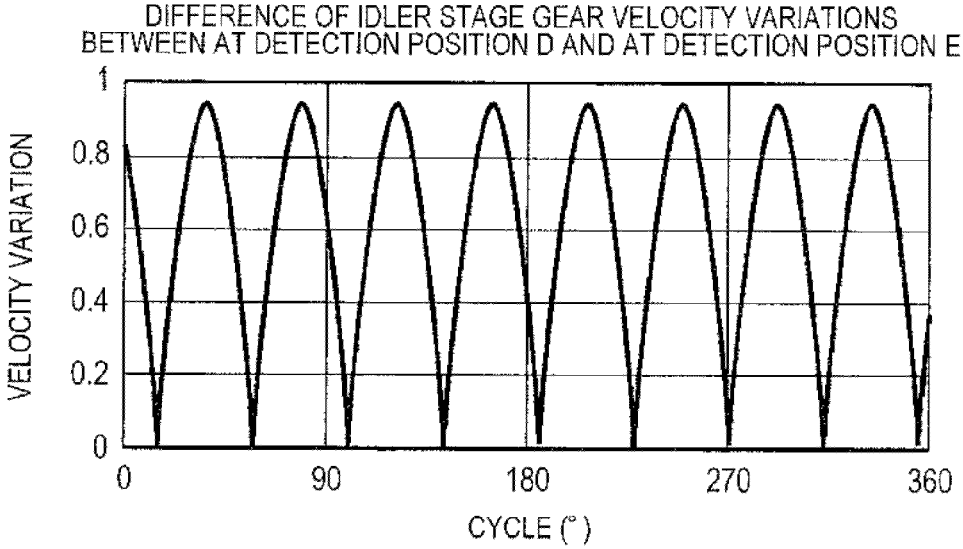
FIG. 25B is a diagram illustrating a velocity variation of the idler gear in one rotation of the photosensitive drum when the exposing position by the exposure means and the detecting position of the electrostatic latent image for detection are at positions of 352.4 degrees.

FIG. 25B illustrates a velocity variation of the idler gear 722 caused by one rotation of the photosensitive drum 22. In the present embodiment, from the exposing position E by the laser scanner unit 20 to the detecting position D of the electrostatic latent image patch 80 for detection it is at the position of 352.4 degrees in the rotation direction of the photosensitive drum 22. The phase deviation is 12 degrees greater than the 340.4 degrees illustrated in FIG. 20A.

In the graph illustrated in FIG. 25B, the velocity variation (amplitude) of the idler gear 722 is ΔVi1, and the rotation angle of the photosensitive member gear 724 is θ. As illustrated in FIG. 21B, the velocity variation (amplitude) in the idler gear 722 caused by one rotation of the photosensitive drum 22 is 0.19. In this case, the velocity variation (amplitude) ΔVi1 of the idler gear 722 is expressed by the following Expression 13.

$$\Delta Vi1=|0.19\times\{\sin(\theta)-\sin(352.4°)\}| \quad \text{Expression 13}$$

Figure 26A:
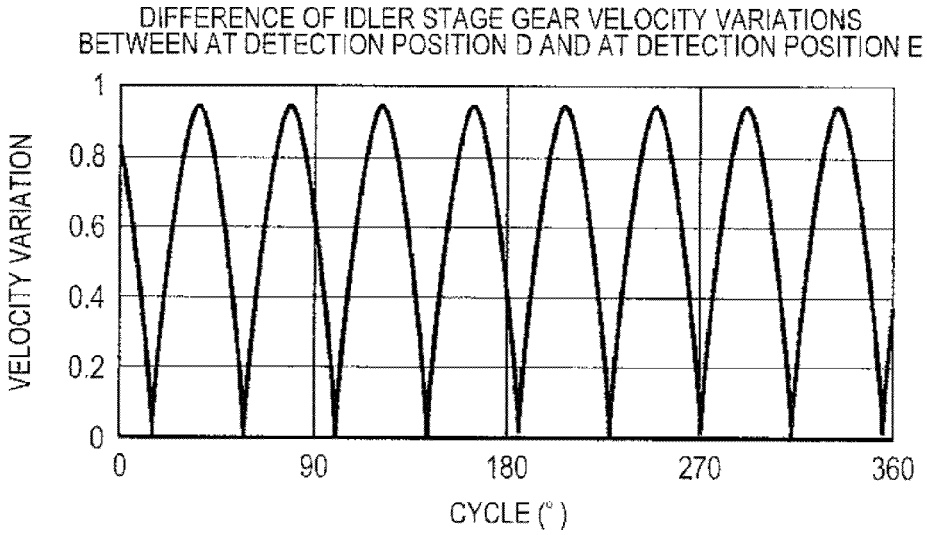
FIG. 26A is a diagram illustrating a velocity variation of the idler stage gear in one rotation of the photosensitive drum when the exposing position by the exposure means and the detecting position of the electrostatic latent image for detection are at positions of 352.4 degrees according to the second embodiment.

FIG. 26A illustrates a velocity variation of the idler stage gear 723 caused by one rotation of the photosensitive drum 22. In the present embodiment, from the exposing position E by the laser scanner unit 20 to the detecting position D of the electrostatic latent image patch 80 for detection it is at the position of 352.4 degrees in the rotation direction of the photosensitive drum 22. The phase deviation is 12 degrees greater than the 340.4 degrees illustrated in FIG. 20A.

In the graph illustrated in FIG. 26A, the velocity variation (amplitude) of the idler stage gear 723 is ΔVi2, and the rotation angle of the photosensitive member gear 724 is θ. As illustrated in FIG. 22A, the velocity variation (amplitude) in the idler stage gear 723 caused by one rotation of the photosensitive drum 22 is 1.1. In this case, the velocity variation (amplitude) ΔVi2 of the idler stage gear 723 is expressed by the following Expression 14.

$$\Delta Vi2=|1.1\times\{\sin(\theta)-\sin(352.4°)\}| \quad \text{Expression 14}$$

Figure 26B:
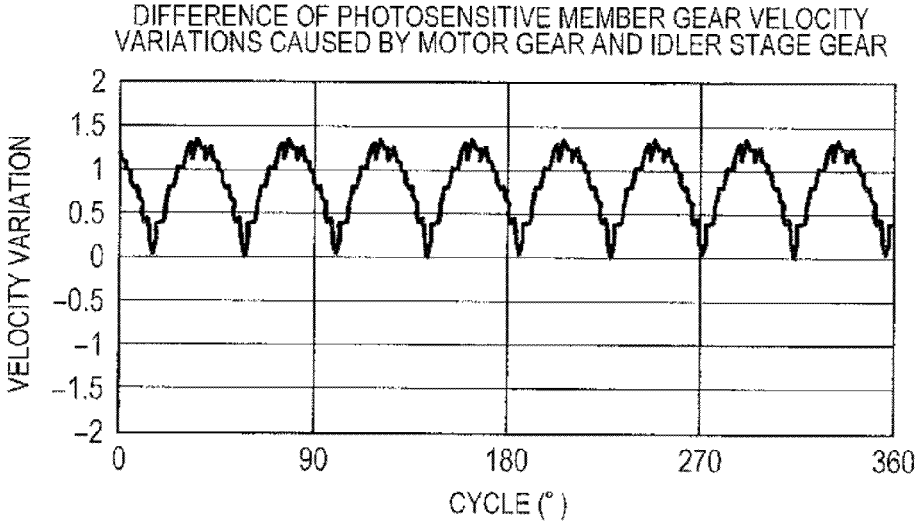
FIG. 26B is a diagram illustrating a velocity variation of a sum of the velocity variations of the motor gear, the idler gear and the idler stage gear in one rotation of the photosensitive drum when the exposing position by the exposure means and the detecting position of the electrostatic latent image for detection are at positions of 352.4 degrees.

A sum of maximum values of the velocity variations (amplitudes) of the motor gear 721, the idler gear 722 and the idler stage gear 723 illustrated in FIGS. 25A, 25B and 26A is generated in the photosensitive member gear 724 as illustrated in FIG. 26B. FIG. 26B depicts synthesis of the velocity variations (amplitudes) of the motor gear 721, the idler gear 722 and the idler stage gear 723 illustrated in FIGS. 25A, 25B and 26A. This serves as a maximum velocity variation (amplitude) of the drive transmission gears from the motor 720 to the photosensitive drum 22, and the maximum velocity variation (amplitude) Vmax in this case is expressed by the following Expression 15 from the graph of FIG. 26B.

$$Vmax\approx 1.3 \quad \text{Expression 15}$$

As a result, a position variation ΔSd on the surface of the photosensitive drum 22 is expressed by the following Expression 16.

$$\Delta Sd\approx 16\ \mu m\times Vmax=16\times 1.3\approx 21\ \mu m \quad \text{Expression 16}$$

More specifically, the photosensitive drum 22 rotates from the exposing position E where the laser beam 21 is emitted by the laser scanner unit 20 to the detecting position D opposing the charge roller 23. If the phase difference in the rotation angle between the photosensitive member gear 724 fixed to the photosensitive drum 22 during the rotation and the idler stage gear 723 is seven degrees, the maximum detection error of about 21 μm may occur on the surface of the photosensitive drum 22.

<Reference Time Value Obtaining Process>

Figure 27:
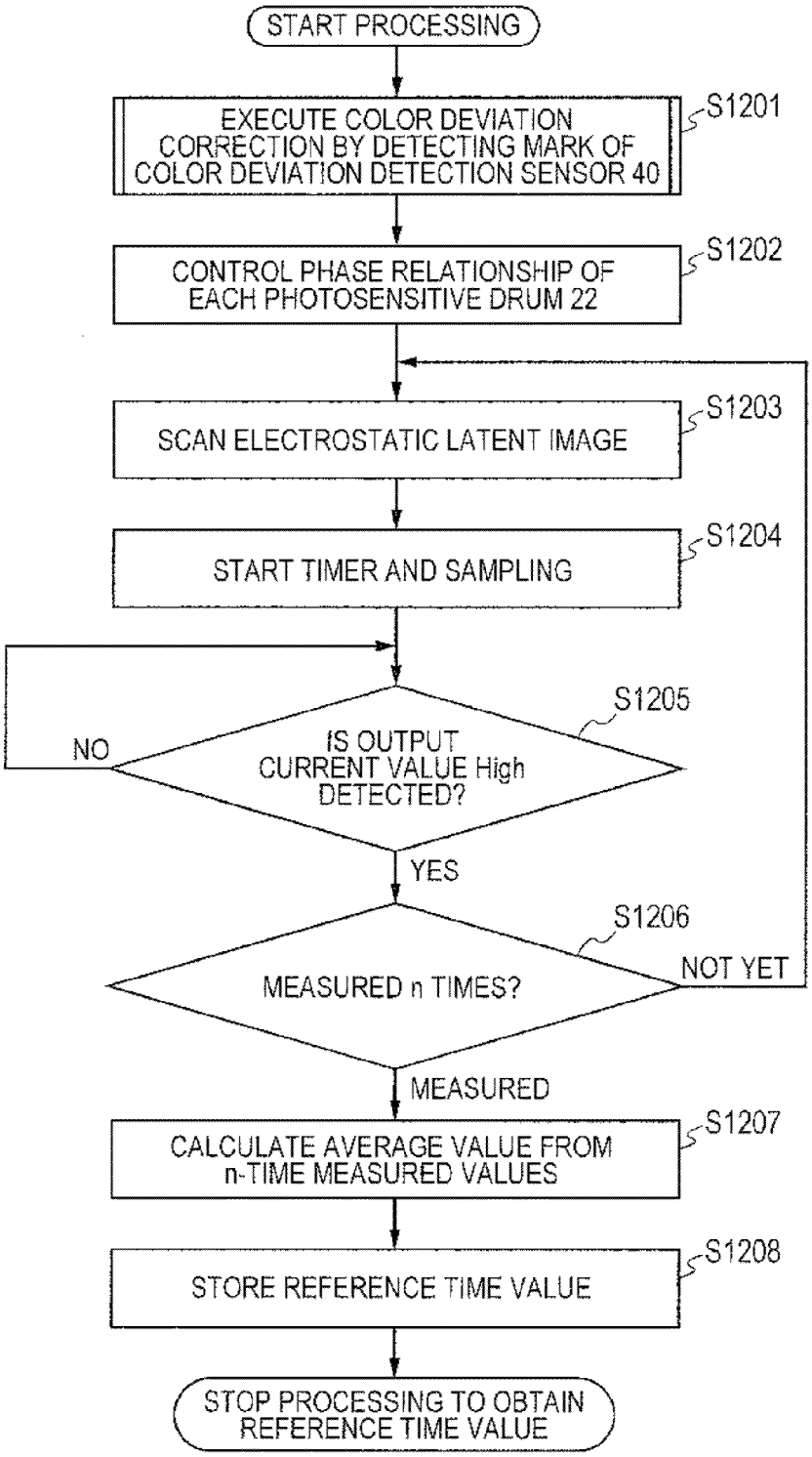
FIG. 27 is a flow chart illustrating a reference time value obtaining process in misregistration correction control of the second embodiment.

A flow chart illustrated in FIG. 27 illustrates a reference time value obtaining process in the misregistration correction control according to the present embodiment. Steps S1201 to S1205 of FIG. 27 are the same as steps S501 to S505 illustrated in FIG. 11 of the first embodiment, and the description will not be repeated.

In step S1205 of FIG. 27, the engine control portion 54 uses the detection value data of the misregistration detection sensor 40 obtained by sampling in step S1204 of FIG. 27. The engine control portion 54 calculates, as a reference time interval, time (count value) at which the detection value of the current flowing through the charge roller 23 as a result of the detection of the electrostatic latent image patch 80 is the maximum.

In step S1206, steps S1203 to S1206 are repeated until the completion of the measurement of the two electrostatic latent image patches 80 formed by shifting the phase on the surface of the photosensitive drum 22.

In step S1207, an average value of the times (count values), at which the detection values of the currents flowing through the charge roller 23 as a result of the detection of the two electrostatic latent image patches 80 formed by shifting the phase on the surface of the photosensitive drum 22 are the maximum, is calculated.

In step S1208, the engine control portion 54 stores a reference time value, which is the time (count value) of the average value calculated in step S1207, in the EEPROM 324.

<Misregistration Correction Control Operation>

Misregistration correction control according to the present embodiment will be described with reference to a flow chart of FIG. 28. The flow chart of FIG. 28 is independently executed for each color.

Figure 28:
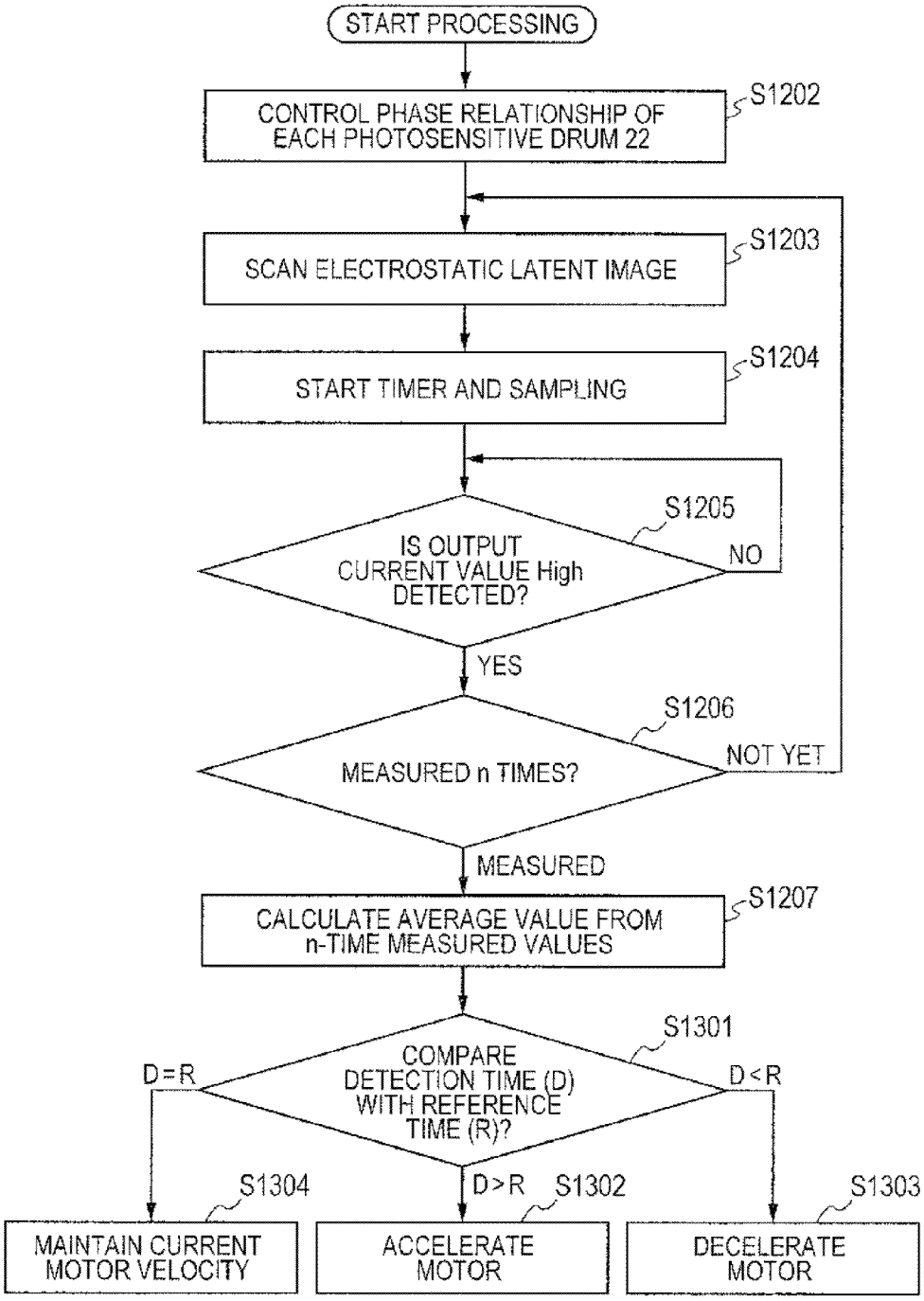
FIG. 28 is a flow chart illustrating another reference time value obtaining process in the misregistration correction control of the second embodiment.

The same process as in steps S1202 to S1207 illustrated in FIG. 27 is executed in steps S1202 to S1207 of FIG. 28, and the description will not be repeated. The rotation axis of the photosensitive drum 22 may be deviated, or there may be an error of outer diameter of the photosensitive member gear 704 in terms of gear accuracy. As a result, the time from the departure of the electrostatic latent image patch 80 from the exposing position E emitted by the laser beam 21 from the laser scanner unit 20 to the arrival at the detecting position D opposing the charge roller 23 is changed. To detect the change, the electrostatic latent image patch 80 is also formed in step S1203 of FIG. 28 at the same exposing position E as in step S1203 of FIG. 27.

In step S1301 of FIG. 28, the engine control portion 54 compares the average time of the detection time intervals with the reference time interval. In step S1205 of FIG. 28, the two electrostatic latent image patches 80 in different phases on the surface of the photosensitive drum 22 are detected to measure two detection time intervals (count values). The average value of the two detection time intervals calculated in step S1207 and the reference time value stored in step S1208 of FIG. 27 are compared.

In step S1301 of FIG. 28, the average value of the two detection time intervals (count values) obtained by the detection of the two electrostatic latent image patches 80 in different phases on the surface of the photosensitive drum 22 may be greater than the reference time value. In that case, the engine control portion 54 as a correcting device performs correction to accelerate the motor 720 during printing to increase the rotation velocity of the photosensitive drum 22 in step S1302.

In step S1301 of FIG. 28, the average value of the two detection time intervals (count values) obtained by the detection of the two electrostatic latent image patch with different phases on the surface of the photosensitive drum 22 may be smaller than the reference time value. In that case, the engine control portion 54 as a correcting device performs correction to decelerate the motor 720 during printing to reduce the rotation velocity of the photosensitive drum 22 in step S1303. If the average value of the detection time intervals and the reference time interval are equal, the rotation velocity of the motor 720 is not changed.

Therefore, the image formation condition correction process in steps S1302 and S1303 of FIG. 28 can correct the misregistration caused by deviation in the rotation axis of the photosensitive drum 22 or caused by an error of outer diameter in the photosensitive member gear 724 in terms of gear accuracy.

In the present embodiment, the laser scanner unit 20 exposes the surface of the photosensitive drum 22 along with the rotation of the photosensitive drum 22 to form the electrostatic latent image patch 80 for detection. The engine control portion 54 that also serves as a measuring device measures the detection time interval until the electrostatic latent image patch 80 for detection detected by the charge roller 23 as a detector reaches the detecting position D.

The time difference between the measured detection time interval and the preset reference time interval is calculated. According to the time difference, the engine control portion 54 that also serves as a correcting device corrects the rotation velocity of the motor 720 as a drive source for rotating and driving the photosensitive drum 22. As a result, the exposure timing of the laser scanner unit 20 can be essentially corrected according to the rotation unevenness of the photosensitive drum 22 caused by rotation unevenness of the drive transmission gear or the like. Other configurations are the same as in other embodiments, and the same advantages can be attained.

As illustrated in the present embodiment, the detection error on the surface of the photosensitive drum is equal to or less than 21 μm. In this case, the photosensitive member gear 724, the idler gear 722 and the idler stage gear 723 rotate an integer number of times. Meanwhile, the angle error of the detecting position D illustrated in FIG. 20A can be equal to or less than 12 degrees in the migration length from the exposing position E to the detecting position D on the surface of the photosensitive drum 22. Other configurations are the same as in the first embodiment, and the same advantages can be attained.

Third Embodiment

Figure 30:
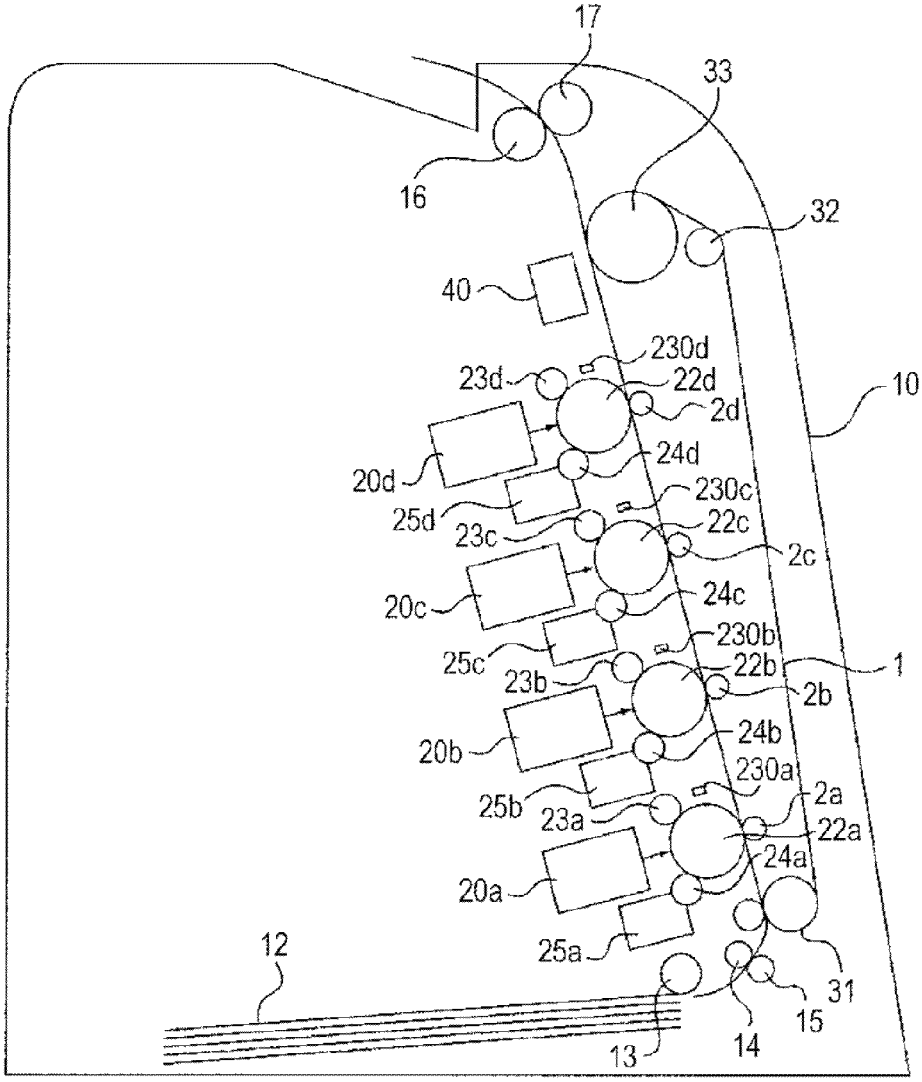
FIG. 30 is a cross-sectional explanatory diagram illustrating a configuration of a third embodiment of the image forming apparatus according to the present invention.

A third embodiment of the image forming apparatus according to the present invention will be described with reference to FIG. 30. In the image forming apparatus 10 of the embodiments described above, the toner image developed on the photosensitive drum 22 is primarily transferred to the intermediate transfer belt 30 and is secondarily transferred from the intermediate transfer belt 30 to the recording material 12 as illustrated in FIGS. 1 to 19. The present embodiment illustrates an example of application to the image forming apparatus 10, in which the toner image developed on the photosensitive drum 22 is directly transferred to the recording material 12 conveyed by a recording material conveyance belt 1 as illustrated in FIG. 30. The same components as in the embodiments described above are designated with the same reference numerals, and the description will not be repeated.

In FIG. 30, the recording material conveyance belt 1 sequentially conveys the recording material 12 to nip portions between the photosensitive drums 22*a* to 22*d* and transfer rollers 2*a* to 2*d* arranged opposite the photosensitive drums 22*a* to 22*d* in the present embodiment. As in the embodiments described above, the image formation process means sequentially and directly transfers the toner image developed on the photosensitive drum 22 to the recording material 12.

The image forming apparatus 10 illustrated in FIG. 30 also has the drive configuration of the photosensitive drum 22 illustrated in the embodiments described above. In this way, the electrostatic latent image patch 80 can be accurately detected. The laser scanner unit 20 exposes the surface of the photosensitive drum 22 along with the rotation of the photosensitive drum 22 to form the electrostatic latent image patch 80 for detection. The engine control portion 54 that also serves as a measuring device measures the detection time interval until the electrostatic latent image patch 80 for detection detected by the charge roller 23 as a detector reaches the detecting position D.

The time difference between the measured detection time interval and the preset reference time interval is calculated. The engine control portion 54 that also serves as a correcting device corrects the exposure timing of the laser scanner unit 20 according to the time difference. In this way, the exposure timing of the laser scanner unit 20 can be corrected according to the rotation unevenness of the photosensitive drum 22 caused by the rotation unevenness of the drive transmission gear or the like. Other configurations are the same as in the embodiments described above, and the same advantages can be attained.

Fourth Embodiment

A fourth embodiment of the image forming apparatus according to the present invention will be described with reference to FIG. 31. In the first and second embodiments, the primary transfer roller 26 as an example of primary transfer means is arranged at a position opposing the photosensitive drum 22, across the intermediate transfer belt 30. In the present embodiment, a transfer member 110 as primary transfer means for forming a primary transfer nip portion by pressuring is arranged at the position opposing the photosensitive drum 22, across the intermediate transfer belt 30, in place of the primary transfer roller 26.

Figure 31:
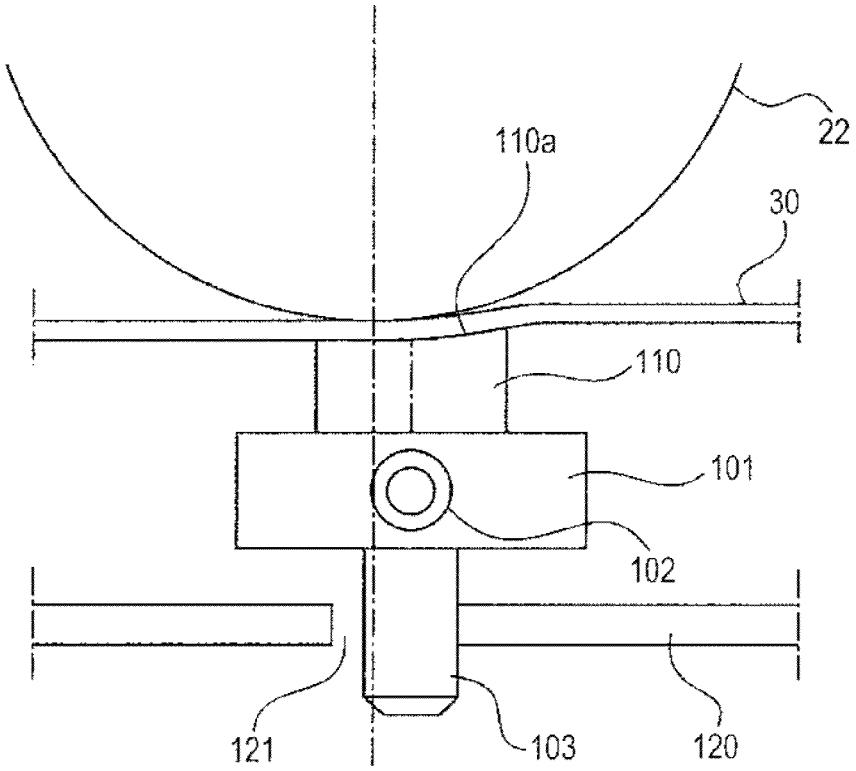
FIG. 31 is a diagram for describing another configuration of the transfer member.

In FIG. 31, a holder 101 rotatably supported around a rotation axis 102 holds the transfer member 110 as primary transfer means. A rotation stopper 103 inserted in a restriction hole 121 arranged on a transfer frame 120 restricts the swinging angle of the holder 101.

The transfer member 110 includes a contact surface 110*a* that is in contact with the intermediate transfer belt 30. The intermediate transfer belt 30 is rubbed against the contact surface 110*a* of the transfer member 110 when the intermediate transfer belt 30 is moving. The toner image is transferred to the intermediate transfer belt 30 from the position opposing the contact surface 110*a* on the photosensitive drum 22.

Contact-type primary transfer means using a transfer blade may also be applied as the primary transfer means.

In the embodiments described above, the electrostatic latent image patch 80 for detection formed on the surface of the photosensitive drum 22 is moved along with the rotation of the photosensitive drum 22. The charge roller 23 is used as the detector for detecting the arrival of the electrostatic latent image patch 80 at the detecting position D arranged around the photosensitive drum 22.

The current detection circuit 50 is included as the detector for detecting the variation at the exposing position E on the surface of the photosensitive drum 22, and a developing sleeve or a transfer roller that can be directly in contact with the photosensitive drum 22 may also be applied as the detector.

The variation at the exposing position E on the surface of the photosensitive drum 22 detected by the detector is fed back to the correction of the misregistration. The variation is also used to control optimization of the bias application timing for starting the operation of rotating the photosensitive drum 22 based on the detection timing by the detector. In this case, the image forming apparatus 10 with the configuration can accurately detect the potential of the electrostatic latent image patch 80 in the same way.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-220915, filed Oct. 5, 2011, which is hereby incorporated by reference herein in its entirety.

What is claimed is:

1. An image forming apparatus comprising:

a photosensitive member;

a rotation member that rotates to rotate the photosensitive member;

a light emitter that emits light to the photosensitive member and forms a latent image;

a detector including a detecting member positioned at a detecting position, wherein the detector detects that the latent image on the photosensitive member reaches the detecting position by detecting a change in a current flowing between the detecting member and the photosensitive member, with the detecting member being a charging member configured to charge the photosensitive member, and the detecting position is a position for charging a surface of the photosensitive member by the charging member;

a measuring device that measures time; and a correcting device that performs a correction according to a variation of a light emission position of the light emitter from a reference light emission position, wherein the measuring device measures a time interval from a time when a latent image for detection is formed on the photosensitive member by the light emitter to a time when the latent image for detection reaches the detecting position and is detected by the detector, wherein the correcting device performs the correction based on the time interval measured by the measuring device, and wherein the latent image for detection, which is formed on the photosensitive member at the reference light emission position by the light emitter, moves from the reference light emission position to the detecting position as the rotation member rotates an integer number of times.

2. An image forming apparatus according to claim 1, wherein the correcting device performs the correction based on a difference between the time interval measured by the measuring device and a reference time interval.

3. An image forming apparatus according to claim 1, wherein the correcting device corrects timing of the emission of the light to the photosensitive member by the light emitter to form an image, based on the time interval measured by the measuring device.

4. An image forming apparatus according to claim 1, wherein the correcting device corrects a rotation velocity of the photosensitive member based on the time interval measured by the measuring device.

5. An image forming apparatus according to claim 1, wherein the rotation member is a gear that transmits driving force to the photosensitive member.

6. An image forming apparatus according to claim 5, further comprising:

a photosensitive member gear arranged coaxially with the photosensitive member and engaged with the photosensitive member, wherein the rotation member is a gear that transmits driving force to the photosensitive member gear.

7. An image forming apparatus according to claim 5, further comprising:

another gear that transmits driving force to the gear, wherein the gear rotates one time when the another gear rotates an integer number of times.

8. An image forming apparatus according to claim 1, wherein there are a plurality of the photosensitive members, and latent images formed on the plurality of photosensitive members by the light emitter are visualized by toners of different colors to form toner images of a plurality of colors.

9. An image forming apparatus according to claim 8, further comprising:

a belt to which the toner images formed on the plurality of photosensitive members are transferred.

10. An image forming apparatus according to claim 8, further comprising:

a belt that conveys a recording material to which the toner images formed on the plurality of photosensitive members are transferred.

11. An image forming apparatus according to claim 9, further comprising:

a toner detector that detects the toner on the belt, wherein the correcting device corrects the timing of the emission of the light to the photosensitive member by the light emitter according to output from the toner detector, and wherein the reference light emission position is a light emission position after the correction, by the correcting device, of the timing for emitting the light to the photosensitive member by the light emitter according to the output from the toner detector and before the image formation on the recording material.

12. An image forming apparatus according to claim 1, wherein the correcting device performs the correction so as to correct misregistration according to the variation of a light emission position of the light emitter from a reference light emission.

13. An image forming apparatus according to claim 1, wherein the detecting member contacts with the photosensitive member.

14. An image forming apparatus comprising:

a photosensitive member;

a rotation member that rotates to rotate the photosensitive member;

a light emitter that emits light to the photosensitive member and forms a latent image;

a detector that detects the latent image on the photosensitive member positioned at a detecting position, wherein the detector comprises a charging member configured to charge the photosensitive member, and the detecting position is a position for charging a surface of the photosensitive member by the charging member;

a measuring device that measures time; and a correcting device that performs a correction according to a variation of a light emission position of the light emitter from a reference light emission position, wherein the measuring device measures a time interval from a time when a latent image for detection is formed on the photosensitive member by the light emitter to a time when the latent image for detection reaches the detecting position and is detected by the detector, wherein the correcting device performs the correction based on the time interval measured by the measuring device, and wherein the latent image for detection, which is formed on the photosensitive member at the reference light emission position by the light emitter, moves from the reference light emission position to the detecting position as the rotation member rotates an integer number of times.

15. An image forming apparatus comprising:

a photosensitive member;

a rotation member that rotates to rotate the photosensitive member;

a light emitter that emits light to the photosensitive member and forms a latent image;

a detector including a detecting member positioned at a detecting position, wherein the detector detects that the latent image on the photosensitive member reaches the detecting position by detecting a change in a current flowing between the detecting member and the photosensitive member, with the detecting member being a developing member configured to develop and visualize the latent image by toners;

a measuring device that measures time; and a correcting device that performs a correction according to a variation of a light emission position of the light emitter from a reference light emission position, wherein the measuring device measures a time interval from a time when a latent image for detection is formed on the photosensitive member by the light emitter to a time when the latent image for detection reaches the detecting position and is detected by the detector, wherein the correcting device performs the correction based on the time interval measured by the measuring device, and wherein the latent image for detection, which is formed on the photosensitive member at the reference light emission position by the light emitter, moves from the reference light emission position to the detecting position as the rotation member rotates an integer number of times.

16. An image forming apparatus according to claim 15, wherein the correcting device performs the correction based on a difference between the time interval measured by the measuring device and a reference time interval.

17. An image forming apparatus according to claim 15, wherein the correcting device corrects timing of the emission of the light to the photosensitive member by the light emitter to form an image, based on the time interval measured by the measuring device.

18. An image forming apparatus according to claim 15, wherein the correcting device corrects a rotation velocity of the photosensitive member based on the time interval measured by the measuring device.

19. An image forming apparatus according to claim 15, wherein the rotation member is a gear that transmits driving force to the photosensitive member.

20. An image forming apparatus according to claim 19, further comprising:

a photosensitive member gear arranged coaxially with the photosensitive member and engaged with the photosensitive member, wherein the rotation member is a gear that transmits driving force to the photosensitive member gear.

21. An image forming apparatus according to claim 19, further comprising:

another gear that transmits driving force to the gear, wherein the gear rotates one time when the another gear rotates an integer number of times.

22. An image forming apparatus according to claim 15, wherein there are a plurality of the photosensitive members, and latent images formed on the plurality of photosensitive members by the light emitter are visualized by toners of different colors to form toner images of a plurality of colors.

23. An image forming apparatus according to claim 22, further comprising:

a belt to which the toner images formed on the plurality of photosensitive members are transferred.

24. An image forming apparatus according to claim 22, further comprising:

a belt that conveys a recording material to which the toner images formed on the plurality of photosensitive members are transferred.

25. An image forming apparatus according to claim 23, further comprising:

a toner detector that detects the toner on the belt, wherein the correcting device corrects the timing of the emission of the light to the photosensitive member by the light emitter according to output from the toner detector, and wherein the reference light emission position is a light emission position after the correction, by the correcting device, of the timing for emitting the light to the photosensitive member by the light emitter according to the output from the toner detector and before the image formation on the recording material.

26. An image forming apparatus according to claim 15, wherein the correcting device performs the correction so as to correct misregistration according to the variation of a light emission position of the light emitter from a reference light emission.

27. An image forming apparatus according to claim 15, wherein the detecting member contacts with the photosensitive member.

28. An image forming apparatus comprising:

a photosensitive member;

a rotation member that rotates to rotate the photosensitive member;

a light emitter that emits light to the photosensitive member and forms a latent image;

a detector including a detecting member positioned at a detecting position, wherein the detector detects that the latent image on the photosensitive member reaches the detecting position by detecting a change in a current flowing between the detecting member and the photosensitive member, with the detecting member being a transfer member configured to transfer a toner image on the photosensitive member to a transferred member;

a measuring device that measures time; and a correcting device that performs a correction according to a variation of a light emission position of the light emitter from a reference light emission position, wherein the measuring device measures a time interval from a time when a latent image for detection is formed on the photosensitive member by the light emitter to a time when the latent image for detection reaches the detecting position and is detected by the detector, wherein the correcting device performs the correction based on the time interval measured by the measuring device, and wherein the latent image for detection, which is formed on the photosensitive member at the reference light emission position by the light emitter, moves from the reference light emission position to the detecting position as the rotation member rotates an integer number of times.

29. An image forming apparatus according to claim 28, wherein the correcting device performs the correction based on a difference between the time interval measured by the measuring device and a reference time interval.

30. An image forming apparatus according to claim 28, wherein the correcting device corrects timing of the emission of the light to the photosensitive member by the light emitter to form an image, based on the time interval measured by the measuring device.

31. An image forming apparatus according to claim 28, wherein the correcting device corrects a rotation velocity of the photosensitive member based on the time interval measured by the measuring device.

32. An image forming apparatus according to claim 28, wherein the rotation member is a gear that transmits driving force to the photosensitive member.

33. An image forming apparatus according to claim 32, further comprising:

a photosensitive member gear arranged coaxially with the photosensitive member and engaged with the photosensitive member, wherein the rotation member is a gear that transmits driving force to the photosensitive member gear.

34. An image forming apparatus according to claim 32, further comprising:

another gear that transmits driving force to the gear, wherein the gear rotates one time when the another gear rotates an integer number of times.

35. An image forming apparatus according to claim 28, wherein there are a plurality of the photosensitive members, and latent images formed on the plurality of photosensitive members by the light emitter are visualized by toners of different colors to form toner images of a plurality of colors.

36. An image forming apparatus according to claim 35, further comprising:

a belt to which the toner images formed on the plurality of photosensitive members are transferred.

37. An image forming apparatus according to claim 35, further comprising:

a belt that conveys a recording material to which the toner images formed on the plurality of photosensitive members are transferred.

38. An image forming apparatus according to claim 36, further comprising:

a toner detector that detects the toner on the belt, wherein the correcting device corrects the timing of the emission of the light to the photosensitive member by the light emitter according to output from the toner detector, and wherein the reference light emission position is a light emission position after the correction, by the correcting device, of the timing for emitting the light to the photosensitive member by the light emitter according to the output from the toner detector and before the image formation on the recording material.

39. An image forming apparatus according to claim 28, wherein the correcting device performs the correction so as to correct misregistration according to the variation of a light emission position of the light emitter from a reference light emission.

40. An image forming apparatus according to claim 28, wherein the detecting member contacts with the photosensitive member.

* * * * *